US010023925B2

(12) United States Patent
Kawasaki

(10) Patent No.: US 10,023,925 B2
(45) Date of Patent: Jul. 17, 2018

(54) HOT STAMPED ARTICLE, METHOD OF PRODUCING HOT STAMPED ARTICLE, ENERGY ABSORBING MEMBER, AND METHOD OF PRODUCING ENERGY ABSORBING MEMBER

(75) Inventor: Kaoru Kawasaki, Tokyo (JP)

(73) Assignee: NIPPON STEEL & SUMITOMO METAL CORPORATION, Tokyo (JP)

( * ) Notice: Subject to any disclaimer, the term of this patent is extended or adjusted under 35 U.S.C. 154(b) by 692 days.

(21) Appl. No.: 14/112,584

(22) PCT Filed: May 11, 2012

(86) PCT No.: PCT/JP2012/062209
§ 371 (c)(1),
(2), (4) Date: Oct. 18, 2013

(87) PCT Pub. No.: WO2012/157581
PCT Pub. Date: Nov. 22, 2012

(65) Prior Publication Data

US 2014/0037980 A1 Feb. 6, 2014

(30) Foreign Application Priority Data

May 13, 2011 (JP) ..... 2011-108397
May 13, 2011 (JP) ..... 2011-108564
(Continued)

(51) Int. Cl.
*C21D 1/18* (2006.01)
*C21D 6/00* (2006.01)
(Continued)

(52) U.S. Cl.
CPC ..... *C21D 1/18* (2013.01); *B21B 27/06* (2013.01); *B21B 37/74* (2013.01); *B21J 1/06* (2013.01);
(Continued)

(58) Field of Classification Search
USPC ..... 428/603; 72/365.2, 366.2, 352; 420/87, 420/104–111
See application file for complete search history.

(56) References Cited

U.S. PATENT DOCUMENTS 6,027,581 A 2/2000 Osawa et al.

FOREIGN PATENT DOCUMENTS

CN 1192481 9/1998
CN 101280352 10/2008
(Continued)

OTHER PUBLICATIONS

English machine translation of Maruyama (JP 2005-248320), JPO, accessed Jun. 11, 2015.*
(Continued)

*Primary Examiner* — Humera N Sheikh
*Assistant Examiner* — Xiaobei Wang
(74) *Attorney, Agent, or Firm* — Birch, Stewart, Kolasch & Birch, LLP

(57) ABSTRACT

A hot stamped article has a component composition containing, in terms of % by mass, 0.002% to 0.1% of C, 0.01% to 0.5% of Si, 0.5% to 2.5% of Mn+Cr, 0.1% or less of P, 0.01% or less of S, 0.05% or less of t-Al, 0.005% or less of N, and 0.0005% to 0.004% of B which is optionally contained in a case where the Mn+Cr is 1.0% or more, the remainder being Fe and unavoidable impurities. The hot stamped article has a microstructure composed of, in terms of an area ratio, 0% or more and less than 90% of martensite, 10% to 100% of bainite, and less than 0.5% of unavoidable inclusion structures, or a microstructure composed of, in terms of an area ratio, 99.5% to 100% of bainitic ferrite, and less than 0.5% of unavoidable inclusion structures.

14 Claims, 3 Drawing Sheets

(30) Foreign Application Priority Data

Sep. 12, 2011 (JP) ..... 2011-198160
Sep. 12, 2011 (JP) ..... 2011-198261

(51) Int. Cl.

| | |
|---|---|
| ***C22C 38/02*** | (2006.01) |
| ***C22C 38/04*** | (2006.01) |
| ***C22C 38/06*** | (2006.01) |
| ***C21D 7/13*** | (2006.01) |
| ***C21D 9/00*** | (2006.01) |
| ***C21D 9/46*** | (2006.01) |
| ***C21D 1/673*** | (2006.01) |
| ***C22C 38/00*** | (2006.01) |
| ***C22C 38/20*** | (2006.01) |
| ***C22C 38/22*** | (2006.01) |
| ***C22C 38/24*** | (2006.01) |
| ***C22C 38/26*** | (2006.01) |
| ***C22C 38/28*** | (2006.01) |
| ***C22C 38/32*** | (2006.01) |
| ***B21B 27/06*** | (2006.01) |
| ***B21B 37/74*** | (2006.01) |
| ***B21J 1/06*** | (2006.01) |
| *B21D 22/02* | (2006.01) |

(52) U.S. Cl.

CPC ..... *C21D 1/673* (2013.01); *C21D 6/00* (2013.01); *C21D 7/13* (2013.01); *C21D 9/0068* (2013.01); *C21D 9/46* (2013.01); *C22C 38/001* (2013.01); *C22C 38/004* (2013.01); *C22C 38/02* (2013.01); *C22C 38/04* (2013.01); *C22C 38/06* (2013.01); *C22C 38/20* (2013.01); *C22C 38/22* (2013.01); *C22C 38/24* (2013.01); *C22C 38/26* (2013.01); *C22C 38/28* (2013.01); *C22C 38/32* (2013.01); *B21D 22/022* (2013.01); *C21D 2211/002* (2013.01); *C21D 2211/008* (2013.01); *Y10T 428/1241* (2015.01)

(56) References Cited

FOREIGN PATENT DOCUMENTS

| | | | |
|---|---|---|---|
| CN | 101353755 | | 1/2009 |
| CN | 101696483 | | 4/2010 |
| CN | 102031456 | | 4/2011 |
| CN | 102046829 | | 5/2011 |
| JP | 2001-316727 | | 11/2001 |
| JP | 2005-097725 | | 4/2005 |
| JP | 2005-248320 | | 9/2005 |
| JP | 2005-298956 | | 10/2005 |
| JP | 2006-200020 | | 8/2006 |
| JP | 2006-219741 | | 8/2006 |
| JP | 2007-314817 | | 12/2007 |
| JP | 2010-111936 | * | 5/2010 |
| RU | 2190684 | | 10/2002 |
| RU | 2237101 | | 9/2004 |
| RU | 2395593 | | 7/2010 |
| TW | 2009-32926 | | 8/2009 |

OTHER PUBLICATIONS

English machine translation of Yoshida (JP 2005-298956), JPO, accessed Jun. 11, 2015.*

Decision of Grant dated May 7, 2015 issued in corresponding Russian Application No. 2013149802 [with English Translation].

Office Action dated Feb. 15, 2015 issued in corresponding CN Application No. 201280022714.1.

International Search Report dated Aug. 14, 2012 issued in corresponding PCT Application No. PCT/JP2012/062209 [With English Translation].

* cited by examiner

HOT STAMPED ARTICLE, METHOD OF PRODUCING HOT STAMPED ARTICLE, ENERGY ABSORBING MEMBER, AND METHOD OF PRODUCING ENERGY ABSORBING MEMBER

TECHNICAL FIELD

The present invention relates to a hot stamped article excellent in local deformability, a method of producing the hot stamped article, an energy absorbing member having a difference in tensile strength by 200 MPa or more in a member, and a method of producing the energy absorbing member.

This application is a national stage application of International Application No. PCT/JP2012/062209, filed May 11, 2012, which claims priority to Japanese Patent Application No. 2011-108397, filed on May 13, 2011, Japanese Patent Application No. 2011-108564, filed on May 13, 2011, Japanese Patent Application No. 2011-198160, filed on Sep. 12, 2011, and Japanese Patent Application No. 2011-198261, filed on Sep. 12, 2011, the contents of which are incorporated herein by reference.

BACKGROUND ART

In recent years, an examination for applying a high-strength steel sheet to the vehicle body has been actively made to reduce the weight of a vehicle body from the viewpoint of global environment protection, and thus strength demanded for a steel material has been increasing. However, workability of a steel sheet deteriorates as the strength of the steel sheet increases, and thus the shape-freezing properties need to be considered.

On the other hand, in commonly used press working, a forming load gradually increases, and thus there is a significant problem with improvement in pressing capability in terms of being put into practical use.

In a hot stamping technology, press forming is carried out after heating a steel sheet to a high temperature of an austenite range. Accordingly, the forming load is greatly reduced compared to common press working that is carried out at room temperature.

In addition, in the hot stamping technology, a hardening treatment is carried out concurrently with the press working by cooling the steel sheet in a die, and thus strength corresponding to the content of C in steel may be obtained. Accordingly, the hot stamping technology has attracted attention as a technology of making the shape freezing properties and the strength compatible with each other.

Patent Document 1 discloses a method of obtaining a hot stamped article having tensile strength of 980 MPa or more as a hot stamping technology. However, in this method, it is difficult to obtain a hot stamped article having tensile strength lower than 980 MPa.

Patent Document 2 and Patent Document 3 disclose a technology related to a member using a hot stamping material with low tensile strength, and a production method thereof, and a technology related to a member by a tailored blank to which the technology is applied. However, in these technologies, consideration is not made for delayed fracture characteristics and toughness, and thus it is difficult to say that performance as a member is sufficient.

PRIOR ART DOCUMENT

Patent Document

[Patent Document 1] Japanese Unexamined Patent Application, First Publication No. 2005-097725

[Patent Document 2] Japanese Unexamined Patent Application, First Publication No. 2005-248320

[Patent Document 3] Japanese Unexamined Patent Application, First Publication No. 2006-200020

DISCLOSURE OF THE INVENTION

Problem that the Invention is to Solve

Vehicle parts, particularly, parts such as a frame, a member, and reinforcement are classified into (1) parts that efficiently absorb energy during collision, and (2) parts that have a sufficient proof stress and transmit energy without deformation during collision according to functions.

Particularly, demanded strength for the frame and member gradually increases, and a member having both characteristics of axial compression deformation and bending deformation is demanded. As a method of realizing this, utilization of hot stamping is considered.

That is, it is necessary to construct a portion with low strength in a member by adjusting a component composition in order for a difference in strength to occur after hardening with hot stamping by utilizing a tailored blank material.

A problem to be solved by the present invention is to realize the above-described configuration, particularly, when considering the axial compression deformation, and an object of the present invention is to provide a hot stamped article that has tensile strength less than 980 MPa and is excellent in local deformability, a method of producing the hot stamped article, an energy absorbing member having a difference in strength in a member, and a method of producing the energy absorbing member.

Means for Solving the Problems

The present inventors have extensively studied to accomplish the above-described object. As a result, the present inventors have found that when a component composition of steel and a condition of hot stamping are optimized, the above-described object may be accomplished due to synergism of these.

The present invention has been made on the basis of the above-described finding, and the gist thereof is as follows.

(1) According to a first aspect of the present invention, there is provided a hot stamped article that is obtained by hot stamping a steel sheet for hot stamping. The hot stamped article has a component composition containing, in terms of % by mass, 0.002% to 0.1% of C, 0.01% to 0.5% of Si, 0.5% to 2.5% of Mn+Cr, 0.1% or less of P, 0.01% or less of S, 0.05% or less of t-Al, 0.005% or less of N, and 0.0005% to 0.004% of B which is optionally contained in a case where the Mn+Cr is 1.0% or more, the remainder being Fe and unavoidable impurities. The hot stamped article has a microstructure composed of, in terms of an area ratio, 0% or more and less than 90% of martensite, 10% to 100% of bainite, and less than 0.5% of unavoidable inclusion structures, or a microstructure composed of, in terms of an area ratio, 99.5% to 100% of bainitic ferrite, and less than 0.5% of unavoidable inclusion structures.

(2) In the hot stamped article according to (1), a plated layer may be provided on a surface of the hot stamped article.

(3) In the hot stamped article according to (1) or (2), the component composition may further contain one or more kinds selected from, in terms of % by mass, 0.001% to 0.1% of Ti, 0.001% to 0.05% of Nb, 0.005% to 0.1% of V, and 0.02% to 0.5% of Mo.

(4) In the hot stamped article according to any one of (1) to (3), in a case where the Mn+Cr is less than 1.0%, the component composition may further contain, in terms of % by mass, 0.0005% to 0.004% of B.

(5) According to a second aspect of the present invention, there is provided an energy absorbing member including the hot stamped article according to any one of (1) to (4), and a joint member which is joined to the hot stamped article and has tensile strength of 1180 MPa or more. A difference in tensile strength between the hot stamped article and the joint member is 200 MPa or more.

(6) According to a third aspect of the present invention, there is provided a method of producing a hot stamped article. The method includes: a heating process of heating a slab in order for a surface temperature to be in a temperature range of Ar3 point to 1400° C., the slab having a component composition containing, in terms of % by mass, 0.002% to 0.1% of C, 0.01% to 0.5% of Si, 0.5% to 2.5% of Mn+Cr, 0.1% or less of P, 0.01% or less of S, 0.05% or less of t-Al, 0.005% or less of N, and 0.0005% to 0.004% of B which is optionally contained in a case where the Mn+Cr is 1.0% or more, the remainder being Fe and unavoidable impurities; a hot rolling process of subjecting the heated slab to finish rolling in which a total rolling reduction at a final stand and an immediately previous stand of the final stand is set to 40% or more in a temperature range state in which the surface temperature is Ar3 point to 1400° C., and initiating cooling within one second after the finish rolling to produce a hot-rolled steel sheet; a coiling process of coiling the hot-rolled steel sheet in a temperature range of 650° C. or lower; and a hot stamping process of using the hot-rolled steel sheet as a steel sheet for hot stamping, forming the steel sheet for hot stamping using a die in a state in which the steel sheet is heated to a temperature of Ac3 point or higher, cooling the steel sheet for hot stamping in the die at a cooling rate exceeding 100° C./second in a case where the Mn+Cr is less than 1.0%, or cooling the steel sheet for hot stamping in the die at a cooling rate of 10° C./second to 100° C./second in a case where the Mn+Cr is 1.0% or more to produce the hot stamped article having a microstructure composed of, in terms of an area ratio, 0% or more and less than 90% of martensite, 10% to 100% of bainite, and less than 0.5% of unavoidable inclusion structures, or a microstructure composed of in terms of an area ratio, 99.5% to 100% of bainitic ferrite, and less than 0.5% of unavoidable inclusion structures.

(7) The method of producing a hot stamped article according to (6) may further include a plating process of carrying out a plating treatment with respect to the hot-rolled steel sheet before the hot stamping process. In the hot stamping process, the hot-rolled steel sheet to which the plating treatment is carried out may be used as the steel sheet for hot stamping.

(8) The method of producing a hot stamped article according to (6) may further include a cold rolling process of producing a cold-rolled steel sheet by carrying out cold rolling with respect to the hot-rolled steel sheet before the hot stamping process. In the hot stamping process, the cold-rolled steel sheet may be used as the steel sheet for hot stamping.

(9) The method of producing a hot stamped article according to (6) may further include a cold rolling process of producing a cold-rolled steel sheet by carrying out cold rolling with respect to the hot-rolled steel sheet before the hot stamping process, and a plating treatment process of carrying out a plating treatment with respect to the cold-rolled steel sheet. In the hot stamping process, the cold-rolled steel sheet to which the plating treatment is carried out may be used as the steel sheet for hot stamping.

(10) The method of producing a hot stamped article according to (6) may further include a cold rolling process of producing a cold-rolled steel sheet by carrying out cold rolling with respect to the hot-rolled steel sheet before the hot stamping process, and a continuous annealing process of carrying out continuous annealing with respect to the cold-rolled steel sheet. In the hot stamping process, the cold-rolled steel sheet to which the continuous annealing is carried out may be used as the steel sheet for hot stamping.

(11) The method of producing a hot stamped article according to (6) may further include a cold rolling process of producing a cold-rolled steel sheet by carrying out cold rolling with respect to the hot-rolled steel sheet before the hot stamping process, a continuous annealing process of carrying out continuous annealing with respect to the cold-rolled steel sheet, and a plating treatment process of carrying out a plating treatment with respect to the cold-rolled steel sheet to which the continuous annealing is carried out. In the hot stamping process, the cold-rolled steel sheet to which the continuous annealing and the plating treatment are carried out may be used as the steel sheet for hot stamping.

(12) In the method of producing a hot stamped article according to any one of (6) to (11), the slab may further contain one or more kinds selected from, in terms of % by mass, 0.001% to 0.1% of Ti, 0.001% to 0.05% of Nb, 0.005% to 0.1% of V, and 0.02% to 0.5% of Mo.

(13) In the method of producing a hot stamped article according to any one of (6) to (12), in a case where the Mn+Cr is less than 1.0%, the slab may contain, in terms of % by mass, 0.0005% to 0.004% of B.

(14) According to a fourth aspect of the present invention, there is provided a method of producing an energy absorbing member. The method includes: a joining process of joining the steel sheet for hot stamping according to any one of (6) to (13) to a steel sheet for joint to produce a joined steel sheet; and a hot stamping process of forming the joined steel sheet using a die in a state in which the joined steel sheet is heated to a temperature of Ac3 point or higher, and cooling the joined steel sheet in the die at a cooling rate exceeding 100° C./second in a case where the Mn+Cr is less than 1.0%, or cooling the joined steel sheet in the die at a cooling rate of 10° C./second to 100° C./second in a case where the Mn+Cr is 1.0% or more so as to set a difference in tensile strength between a portion corresponding to the steel sheet for hot stamping and a portion corresponding to the steel sheet for joint in the joined steel sheet to 200 MPa or more.

Advantage of the Invention

According to the present invention, in a case of producing parts utilizing a tailored blank, strength after hot stamping may be suppressed to be low with respect to an axially compression-deformed portion, and thus local deformability may be applied to the parts. As a result, a member, which is excellent in energy absorbing characteristics during axial compression deformation and bending deformation, may be produced.

DESCRIPTION OF EMBODIMENT

Figure 1:
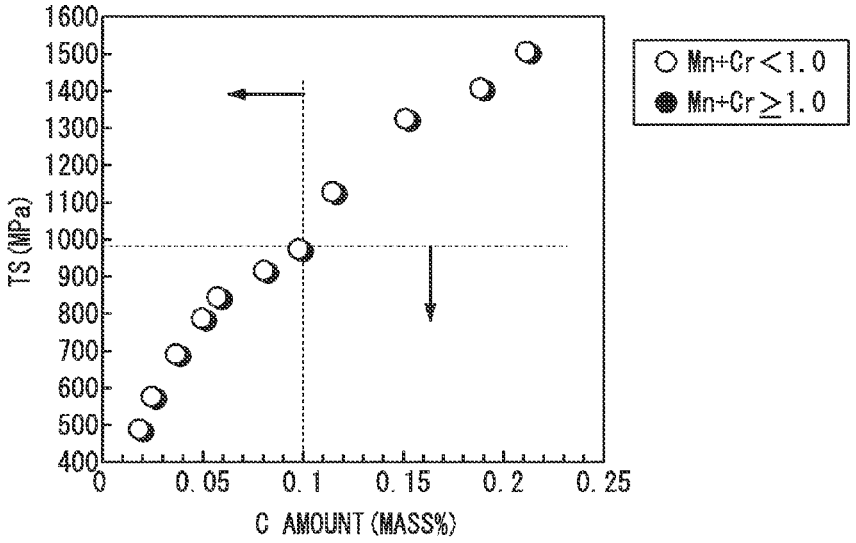
FIG. 1 is a diagram illustrating a relationship between the content of C and tensile strength of a hot stamped article.

First, experiments carried out to complete the present invention will be described.

The present inventors have focused on the content of Mn+Cr which has a great effect on hardenability, and have carried out the following experiments with respect to each of a component composition in which the content of Mn+Cr is less (less than 1.0% by mass), and a component composition in which the content of Mn+Cr is much (1.0% by mass or more).

The present inventors have investigated a relationship between the content of C and tensile strength (TS) of steel during a heat treatment under conditions of reproducing thermal history in hot stamping, that is, conditions of heating to 900° C. and then cooling to room temperature at 200° C./second by using cold-rolled annealed sheets shown in Table 1, which have component compositions in which the content of Mn+Cr is less than 1.0% and boron is not contained, and which have a sheet thickness of 1.6 mm.

In addition, the present inventors have investigated a relationship between the content of C and tensile strength (TS) during a heat treatment under conditions of reproducing thermal history in hot stamping, that is, conditions of heating to 900° C. and then cooling to room temperature at 50° C./second by using cold-rolled annealed sheets shown in Table 2, which have component compositions in which the content of Mn+Cr is 1.0% or more and boron is contained, and which have a sheet thickness of 1.6 mm. In addition, in the component compositions shown in Table 2, an appropriate amount of boron is added to obtain a sufficient hardening effect even at a cooling rate (50° C./second) that is set to be slower compared to the cooling rate of 200° C./second.

TABLE 1

| | C | Si | Mn | Cr | P | S | t-Al | B | N | Mn + Cr | Ac3 | Microstructure (area ratio) | | |
|---|---|---|---|---|---|---|---|---|---|---|---|---|---|---|
| No. | mass % | | | | | | | | | | ° C. | M | B | Others |
| 1 | 0.017 | 0.22 | 0.75 | 0.22 | 0.008 | 0.0042 | 0.028 | — | 0.0025 | 0.97 | 888 | 0 | 100 | <0.5 |
| 2 | 0.023 | 0.14 | 0.98 | 0.01 | 0.012 | 0.0018 | 0.035 | — | 0.0028 | 0.99 | 878 | 0 | 100 | <0.5 |
| 3 | 0.035 | 0.15 | 0.81 | 0.18 | 0.014 | 0.0025 | 0.027 | — | 0.0034 | 0.99 | 875 | 70 | 30 | <0.5 |
| 4 | 0.049 | 0.13 | 0.58 | 0.25 | 0.015 | 0.0027 | 0.034 | — | 0.0029 | 0.83 | 878 | 60 | 40 | <0.5 |
| 5 | 0.057 | 0.14 | 0.81 | 0.18 | 0.015 | 0.0021 | 0.032 | — | 0.0032 | 0.99 | 867 | 60 | 40 | <0.5 |
| 6 | 0.079 | 0.15 | 0.75 | 0.19 | 0.012 | 0.0018 | 0.026 | — | 0.0022 | 0.94 | 856 | 80 | 20 | <0.5 |
| 7 | 0.097 | 0.15 | 0.68 | 0.22 | 0.016 | 0.0019 | 0.033 | — | 0.0033 | 0.90 | 857 | 85 | 15 | <0.5 |
| 8 | 0.115 | 0.13 | 0.74 | 0.22 | 0.014 | 0.0023 | 0.028 | — | 0.0029 | 0.96 | 846 | 100 | 0 | <0.5 |
| 9 | 0.151 | 0.16 | 0.88 | 0.05 | 0.015 | 0.0015 | 0.025 | — | 0.0033 | 0.93 | 832 | 100 | 0 | <0.5 |
| 10 | 0.188 | 0.15 | 0.88 | 0.11 | 0.015 | 0.0018 | 0.031 | — | 0.0029 | 0.99 | 825 | 100 | 0 | <0.5 |
| 11 | 0.212 | 0.14 | 0.48 | 0.49 | 0.014 | 0.0021 | 0.033 | — | 0.0031 | 0.97 | 831 | 100 | 0 | <0.5 |

M: martensite,
B: bainite,
Others: unavoidable inclusion structures

TABLE 2

| | C | Si | Mn | Cr | P | S | t-Al | B | N | Mn + Cr | Ac3 | Microstructure (area ratio) | | |
|---|---|---|---|---|---|---|---|---|---|---|---|---|---|---|
| No. | mass % | | | | | | | | | | ° C. | M | B | Others |
| 1' | 0.017 | 0.22 | 0.75 | 0.37 | 0.008 | 0.0042 | 0.028 | 0.0009 | 0.0025 | 1.12 | 888 | 0 | 100 | <0.5 |
| 2' | 0.023 | 0.14 | 1.24 | 0.22 | 0.012 | 0.0018 | 0.035 | 0.0015 | 0.0028 | 1.46 | 871 | 0 | 100 | <0.5 |
| 3' | 0.035 | 0.15 | 1.35 | 0.18 | 0.014 | 0.0025 | 0.027 | 0.0008 | 0.0034 | 1.53 | 859 | 70 | 30 | <0.5 |
| 4' | 0.049 | 0.13 | 1.27 | 0.25 | 0.015 | 0.0027 | 0.034 | 0.0012 | 0.0029 | 1.52 | 857 | 60 | 40 | <0.5 |
| 5' | 0.057 | 0.14 | 1.08 | 0.37 | 0.015 | 0.0021 | 0.032 | 0.0007 | 0.0032 | 1.45 | 859 | 60 | 40 | <0.5 |
| 6' | 0.079 | 0.15 | 1.35 | 0.19 | 0.012 | 0.0018 | 0.026 | 0.0017 | 0.0022 | 1.54 | 838 | 80 | 20 | <0.5 |
| 7' | 0.097 | 0.15 | 1.23 | 0.22 | 0.016 | 0.0019 | 0.033 | 0.0010 | 0.0033 | 1.45 | 841 | 85 | 15 | <0.5 |
| 8' | 0.115 | 0.13 | 1.32 | 0.31 | 0.014 | 0.0023 | 0.028 | 0.0011 | 0.0029 | 1.63 | 828 | 100 | 0 | <0.5 |
| 9' | 0.151 | 0.16 | 1.05 | 0.72 | 0.015 | 0.0015 | 0.025 | 0.0008 | 0.0033 | 1.77 | 827 | 100 | 0 | <0.5 |
| 10' | 0.188 | 0.15 | 1.22 | 0.24 | 0.015 | 0.0018 | 0.031 | 0.0017 | 0.0029 | 1.46 | 815 | 100 | 0 | <0.5 |
| 11' | 0.212 | 0.14 | 1.19 | 0.36 | 0.014 | 0.0021 | 0.033 | 0.0012 | 0.0031 | 1.55 | 810 | 100 | 0 | <0.5 |

M: martensite,
B: bainite,
Others: unavoidable inclusion structures

No. 5 test specimens were prepared from a steel sheet after being subjected to a heat treatment on the basis of JIS Z 2241 (2011), and a tensile test was carried out. Results that were obtained are shown in FIG. 1. In FIG. 1, "○" represents a result of steel corresponding to Table 1, and "●" represents a result of steel corresponding to Table 2.

From Table 1, Table 2, and FIG. 1, it was found that it is necessary to set the content of C in steel to 0.1% by mass or less so as to make tensile strength after hot stamping less than 980 MPa. When confirming a microstructure of a test specimen in which tensile strength after hot stamping was less than 980 MPa, it was found that the microstructure was composed of less than 90% of martensite, 10% or more of bainite, and less than 0.5% of unavoidable inclusion structures.

Furthermore, a steel sheet of No. 5 in Table 1 and a steel sheet of No. 5' in Table 2 were used. These steel sheets were heated to 900° C. at a heating rate of 10° C./second and were heat-retained for 20 seconds, and then were immediately cooled to room temperature at various cooling rates. Then, a tensile test was carried out by the same method as the above-described tensile test, and hole expansibility that exhibited a good correlation with local deformability was examined.

The examination of the hole expansibility was carried out by a method described in JIS Z 2256 (2010). That is, a hole with a diameter 10 mm ($d_0$) was punched in each of the steel sheets, and the hole was expanded by using a conical punch of 60° in such a manner that a burr was formed at an outer side. Then, a hole diameter (d) at the point of time at which cracking penetrates through a sheet thickness was measured, and evaluation was carried out by $\lambda$ ($=((d-d_0)/d_0)\times 100$).

Figure 2:
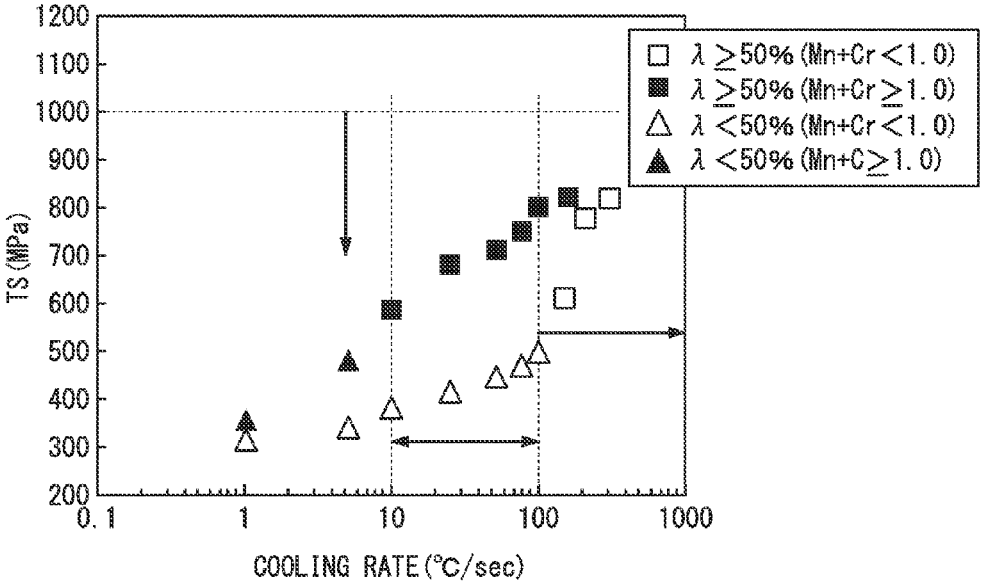
FIG. 2 is a diagram illustrating a relationship between a cooling rate during hot stamping and tensile strength of the hot stamped article.

A relationship between the cooling rate and the tensile strength after the hot stamping is shown in FIG. 2. In FIG. 2, steel sheets, which are evaluated as $\lambda \geq 50\%$, are plotted with rectangles (a case in which Mn+Cr is less than 1.0%: □, and a case in which Mn+Cr is 1.0% or more: ■), steel sheets, which are evaluated as $\lambda < 50\%$, are plotted with triangles (a case in which Mn+Cr is less than 1.0%: Δ, and a case in which Mn+Cr is 1.0% or more: ▲).

As can be from FIG. 2, in a component composition in which Mn+Cr is less than 1.0% (plotted with □ and Δ), in a case where the cooling rate is 100° C./second or less, a structure becomes "ferrite+pearlite" or "ferrite+bainite", and the hole expansibility deteriorates due to a difference in hardness in the structure, and thus the local deformability is not sufficient. As a result, particularly, stable deformation behavior may not be obtained during axial compression deformation.

In addition, in a component composition in which Mn+Cr is less than 1.0% (plotted with □ and Δ), when a steel sheet is cooled at a cooling rate exceeding 100° C./second, a structure including "bainite", "martensite", or "bainite+martensite" may be obtained, and thus tensile strength exceeding 450 MPa may be obtained, and $\lambda$ is 50% or more. Accordingly, particularly, a stable deformation behavior may be obtained during axial compression deformation.

Furthermore, as can be seen from FIG. 2, in a component composition in which Mn+Cr is 1.0% or more (plotted with ■ and ▲), in a case where the cooling rate is less than 10° C./second, a structure becomes "ferrite+pearlite" or "ferrite+bainite", and the hole expansibility deteriorates due to a difference in hardness in the structure, and thus the local deformability is not sufficient. As a result, particularly, a stable deformation behavior may not be obtained during axial compression deformation. Therefore, it can be understood that it is necessary to set the lower limit of the cooling rate to 10° C./second, and preferably 30° C./second. On the other hand, when the steel sheet is cooled at a cooling rate exceeding 100° C./second, tensile strength exceeding 980 MPa is obtained, and thus particularly, stable deformation behavior may not be obtained during axial compression deformation. Accordingly, it can be understood that it is necessary to set the upper limit of the cooling rate to 100° C./second, and preferably 70° C./second.

On the basis of the experimental results, the present inventors have found that when the component composition of the hot stamped article is controlled to obtain a microstructure composed of in terms of an area ratio, 0% or more and less than 90% of martensite, 10% to 100% of bainite, and less than 0.5% of unavoidable inclusion structures, or a microstructure composed of, in terms of an area ratio, 99.5% to 100% of bainitic ferrite, and less than 0.5% of unavoidable inclusion structures, excellent local deformability may be applied to the hot stamped article. Hereinafter, the present invention accomplished on the basis of the above-described finding will be described in detail with reference to embodiments.

First Embodiment

The first embodiment of the present invention relates to a hot stamped article that may be obtained by hot-stamping a steel sheet for hot stamping.

First, a microstructure of the hot stamped article according to this embodiment will be described. % related to the microstructure represents an area ratio. In addition, with regard to each structure, the area ratio is calculated by carrying out image analysis with respect to a scanning electron microscope (SEM) photograph.

(Martensite: 0% or more and less than 90%)

The microstructure of the hot stamped article according to this embodiment contains less than 90% of martensite. When martensite is set to 90% or more, the tensile strength of the hot stamped article may not be suppressed to 980 MPa or less. On the other hand, an area ratio of martensite may be 0%. It is preferable that the area ratio of martensite be 85% or less, and more preferably 80% or less.

(Bainite: 10% to 100%)

The microstructure of the hot stamped article according to this embodiment contains 10% to 100% of bainite in addition to 0% or more and less than 90% of martensite. Since a difference in hardness between martensite and bainite is small, even when both of these are mixed in, there is no great effect on the hole expansibility. That is, satisfactory local deformability may be obtained. In a case where bainite is less than 10%, since martensite as the remainder increases, it is difficult to suppress the tensile strength of the hot stamped article to 980 MPa or less. Therefore, it is preferable that the lower limit of the area ratio of bainite be 15%, and more preferably 20%. On the other hand, it is preferable that the upper limit of the area ratio of bainite be 100%. However, the upper limit may be 99.5% when considering unavoidable inclusion structures to be described later.

(Bainitic Ferrite: 99.5% to 100%)

In addition, in a case of using steel having a component composition in which the content of C is 0.01% or less, an amount of cementite that precipitates by hot stamping is not sufficient, and thus it is difficult to obtain a bainitic structure. Therefore, the microstructure of the hot stamped article according to this embodiment may be a microstructure that is substantially composed of bainitic ferrite, that is, a microstructure including 99.5% or more of bainitic ferrite. In a case where the area ratio of the bainitic ferrite is less than 99.5%, there is a concern that the hole expansibility may decrease due to a difference in hardness with other structures, and thus the lower limit is set to 99.5%.

(Unavoidable Inclusion Structures: less than 0.5%)

The microstructure of the hot stamped article according to this embodiment may contain structures such as ferrite (ferrite other than bainitic ferrite) and pearlite as long as the structures are contained in a ratio of 0.5% or less. However, these structures have a large difference in hardness with martensite, and apply a difference in hardness to the inside of the hot stamped article. Therefore, the hole expansibility deteriorates, thereby leading to a deterioration in the local deformability. Therefore, it is preferable to reduce the structures as much as possible.

As described above, the hot stamped article according to this embodiment has a microstructure composed of, in terms of an area ratio, 0% or more and less than 90% of martensite, 10% to 100% of bainite, and less than 0.5% of unavoidable inclusion structures, or a microstructure composed of, in terms of an area ratio, 99.5% to 100% of bainitic ferrite, and less than 0.5% of unavoidable inclusion structures.

Next, a component composition of the hot stamped article (and a slab that is a raw material thereof) according to this embodiment will be described. In addition, % related to the component composition represents % by mass.

(C: 0.002% to 0.1%)

C is an element that determines strength, and is an element that has a great effect on strength, particularly, after hardening. In the present invention, the tensile strength of the hot stamped article is set to be less than 980 MPa, and thus the upper limit of the content of C is set to 0.1%, preferably 0.06%, and more preferably 0.05%. On the other hand, when decarburization is carried out to a low carbon range, the decarburization cost increases, and it is difficult to obtain necessary strength within a range less than 980 MPa. Therefore, the lower limit of the content of C is set to 0.002%, preferably 0.005%, and more preferably 0.01%.

(Si: 0.01% to 0.5%)

Si is a solid-solution strengthening element, and thus Si is added in a ratio of 0.01% or more. However, when Si is added in a ratio of more than 0.5%, plating properties deteriorate, and thus the upper limit thereof is set to 0.5%. It is preferable that the lower limit of the content of Si be 0.05%, and more preferably 0.1%. In addition, it is preferable that the upper limit of the content of Si be 0.4%, and more preferably 0.3%.

(Mn+Cr: 0.5% to 2.5%)

Mn and Cr are elements that are added to secure hardenability. When the content of Mn+Cr is less than 0.5%, sufficient hardenability may not be secured. Therefore, the lower limit of the content of Mn+Cr is set to 0.5%, preferably 0.6%, and more preferably 0.7%. On the other hand, when the content of Mn+Cr exceeds 2.5%, hardenability increases, and thus it is difficult to suppress tensile strength to be low. Therefore, the upper limit of Mn+Cr is set to 2.5%, preferably 2.3%, and more preferably 2.0%.

As described later, when the content of Mn+Cr is less than 1.0%, a microstructure composed of, in terms of an area ratio, 0% or more and less than 90% of martensite, 10% to 100% of bainite, and less than 0.5% of unavoidable inclusion structures, or a microstructure composed of in terms of an area ratio, 99.5% to 100% of bainitic ferrite, and less than 0.5% of unavoidable inclusion structures is made by performing cooling at a cooling rate exceeding 100° C./second during hot stamping. When using this cooling condition, it is preferable that the content of Mn+Cr be 0.9% or less, and more preferably 0.5% or less so as to suppress formation of ferrite to the utmost.

On the other hand, when the content of Mn+Cr is 1.0% or more, the microstructure composed of, in terms of an area ratio, 0% or more and less than 90% of martensite, 10% to 100% of bainite, and less than 0.5% of unavoidable inclusion structures, or a microstructure composed of in terms of an area ratio, 99.5% to 100% of bainitic ferrite, and less than 0.5% of unavoidable inclusion structures is made by performing cooling at a cooling rate of 10° C./second to 100° C./second during hot stamping. When using this cooling condition, it is preferable that the content of Mn+Cr be 1.4% or more, and more preferably 1.5% or more.

The lower limit of the content of Mn may be set to 0.1%, and preferably 0.5%, and the upper limit may be set to 1.5%.

The lower limit of the content of Cr may be set to 0.01%, and preferably 0.2%, and the upper limit may be set to 1.5%.

(P: 0.1% or less)

P is a solid-solution strengthening element, and may increase strength of a steel sheet at relatively low cost. However, P is an element that has a tendency to precipitate at a grain boundary, and causes low-temperature embrittlement in a case where strength is high. Therefore, the content of P is limited to 0.1% or less. It is preferable that the content of P be limited to 0.020% or less, and more preferably 0.015% or less. It is preferable that the content of P be as small as possible, but reduction of P to less than 0.001% may cause an increase in the dephosphorization cost, and thus the content of P may be set to 0.001% or more.

(S: 0.01% or less)

S is an element that deteriorates hot workability, and deteriorates workability of a steel sheet. Therefore, the content of S is limited to 0.01% or less. The content of S is preferably limited to 0.005% or less. It is preferable that the content of S be as small as possible, but reduction of S to less than 0.001% may cause an increase in the desulfurization cost, and thus the content of S may be set to 0.001% or more.

(t-Al: 0.05% or less)

Al is an element that is commonly added for deoxidation. When the content of t-Al is less than 0.005%, deoxidation is not sufficient, and a large amount of oxides remain in steel, thereby causing deterioration of local deformability. Therefore, the content of Al is preferably 0.005% or more. On the other hand, when the content of Al exceeds 0.05%, a large amount of oxides mainly composed of alumina remain in steel, thereby causing deterioration of local deformability. Therefore, it is preferable that the content of Al be 0.05% or less, and more preferably 0.04% or less. In addition, t-Al represents total aluminum.

(N: 0.005% or less)

N is an element which is preferable as less as possible, and N is limited to 0.005% or less. Reduction of the content of N to less than 0.001% may cause an increase in the refining cost, and thus the content of N may be set to 0.001% or more. On the other hand, when the content of N exceeds 0.003%, precipitates are generated, and toughness after hardening deteriorates, and thus the content of N is preferably 0.003% or less.

(In a case where Mn+Cr is 1.0% or more, B: 0.0005% to 0.004%) In a case where the content of Mn+Cr is 1.0% or more, B is added in a range of 0.0005% to 0.004%. When B is added, even when cooling is carried out at a cooling rate of 100° C./second or less during hot stamping, hardenability may be secured.

The lower limit of the content of B may be set to 0.0008%, and preferably 0.0010% so as to obtain the addition effect of B. However, when the content of B exceeds 0.004%, the addition effect is saturated, and thus the upper limit of the content of B is 0.004%, and preferably 0.002%.

In addition, as described later, even in a case in which the content of Mn+Cr is less than 1.0%, 13 may be added.

The component composition of the hot stamped article according to this embodiment may contain at least one kind selected from a group consisting of B, Ti, Nb, V, and Mo as a selective element. That is, the present invention includes a case in which these elements are 0%.

(In a case where Mn+Cr is less than 1.0%, B: 0% to 0.004%)

B is an element that improves hardenability, and thus even in steel in which the content of C is small, B is added to allow the structure of steel to be composed of bainite or martensite so as to secure necessary strength.

Accordingly, even in a case where Mn+Cr is less than 1.0%, the lower limit of the content of B may be set to 0.0005% to obtain the addition effect of B, and preferably 0.0008% or 0.0010%. However, when the content of B exceeds 0.004%, the addition effect is saturated, and thus the upper limit of the content of B is 0.004%, and preferably 0.002%.

(Ti: 0% to 0.1%)

(Nb: 0% to 0.05%)

Ti and Nb are elements that form fine carbides, and make the grain size of prior-austenite after hot stamping fine. To obtain an addition effect, the lower limit of each of Ti and Nb may be set to 0.001%, and preferably 0.01%. On the other hand, when these elements are excessively added, the addition effect is saturated, and the production cost increases. Therefore, with regard to the content of Ti, the upper limit thereof is set to 0.1%, and preferably 0.08%, and with regard to the content of Nb, the upper limit thereof is set to 0.05%, and preferably 0.03%.

(V: 0% to 0.1%)

V is an element that forms carbides and makes a structure fine. When a steel sheet is heated to an Ac3 point or higher, fine V carbides suppress recrystallization and grain growth, thereby making austenite grains fine and improving toughness. When the content of V is less than 0.005%, the addition effect may not be obtained, and thus the lower limit of V is set to 0.005%, and preferably 0.01%. On the other hand, when the content of V exceeds 0.1%, the addition effect is saturated, and the production cost increases. Therefore, the upper limit of the content of V is set to 0.1%, and preferably 0.07%.

(Mo: 0% to 0.5%)

Similar to Ti, Nb, and V, Mo is an element which also forms fine carbides when a steel sheet is heated to the Ac3 point or higher, suppresses recrystallization and grain growth, makes austenite grains fine, and improves toughness. When the content of Mo is less than 0.02%, the addition effect may not be obtained, and thus the lower limit of the content of Mo may be set to 0.02%, and preferably 0.08%. On the other hand, when the content of Mo exceeds 0.5%, the addition effect is saturated, and the production cost increases. Therefore, the upper limit of the content of Mo is set to 0.5%, and preferably 0.3%.

In addition, the hot stamped article of the present invention may contain Cu, Sn, Ni, and the like, which are mixed-in from scrap or the like during a steel-making stage, in a range not deteriorating the effect of the present invention. In addition, the hot stamped article may contain Ca that is used as a deoxidizing element, and a REM including Ce and the like within a range not deteriorating the effect of the invention. Specifically, the hot stamped article may contain 0.1% or less of Cu, 0.02% or less of Sn, 0.1% or less of Ni, 0.01% or less of Ca, and 0.01% of REM as unavoidable impurities.

Hereinafter, a method of producing the hot stamped article according to this embodiment will be described in detail.

The method of producing the hot stamped article according to this embodiment includes at least a heating process, a hot rolling process, and a hot stamping process. That is, a microstructure composed of, in terms of an area ratio, 0% or more and less than 90% of martensite, 10% to 100% of bainite, and less than 0.5% of unavoidable inclusion structures, or a microstructure composed of, in terms of an area ratio, 99.5% to 100% of bainitic ferrite, and less than 0.5% of unavoidable inclusion structures is made by appropriately controlling heating conditions, hot rolling conditions, and hot stamping conditions.

(Heating Process)

In the heating process, a slab having the above-described component composition is heated in order for a surface temperature to be in a temperature range of Ar3 point to 1400° C. This is because it is necessary to make a grain size of prior-austenite, which is obtained after hot stamping, as small as possible from the viewpoint of securing necessary delayed fracture characteristics and toughness. That is, to make a structure of a hot-rolled sheet stage fine, the heating temperature is set to 1400° C. or lower, and preferably 1250° C. or lower. On the other hand, in a case where the surface temperature exceeds 1400° C., rolling properties deteriorate, and thus the upper limit of the heating temperature is set to 1400° C.

In addition, a method of producing a steel slab that is provided to hot rolling is not limited to a continuous casting method. A common continuous casting method, or a method of casting a thin slab having a thickness of 100 mm or less may be employed.

(Hot Rolling Process)

In the hot rolling process, the heated slab is subjected to finish rolling in which a total rolling reduction at a final stand and an immediately previous stand of the final stand is set to 40% or more in a temperature range state in which the surface temperature is Ar3 point to 1400° C., and cooling is initiated within one second after the finish rolling. According to this, a hot-rolled steel sheet which is used as a steel sheet for hot stamping is produced.

(Coiling Process)

In the coiling process, the hot-rolled steel sheet is coiled in a temperature range of 650° C. or less. In a case of coiling the hot-rolled steel sheet in a temperature range exceeding 650° C., coil deformation (coil buckling) has a tendency to occur after coiling, and 650° C. is set as the upper limit.

In addition, when the hot-rolled steel sheet is coiled at a temperature lower than 400° C., the strength of the hot-rolled steel sheet increases too much, and thus the coiling temperature is preferably 400° C. or higher. However, after being coiled at a temperature lower than 400° C., the hot-rolled steel sheet may be reheated for the purpose of softening.

(Hot Stamping Process)

In the hot stamping process, the above-described hot-rolled steel sheet is used a steel sheet for hot stamping, and the steel sheet for hot stamping is formed using a die in a state in which the steel sheet is heated to a temperature of Ac3 point or higher. In addition, the steel sheet for hot stamping is cooled in the die at a cooling rate exceeding 100° C./second in a case where the Mn+Cr is less than 1.0%, or the steel sheet for hot stamping is cooled in the die at a cooling rate of 10° C./second to 100° C./second in a case where the Mn+Cr is 1.0% or more. When the hot stamping is carried out under these temperature conditions, a hot stamped article having a microstructure composed of, in terms of an area ratio, 0% or more and less than 90% of martensite, 10% to 100% of bainite, and less than 0.5% of unavoidable inclusion structures, or a microstructure composed of in terms of an area ratio, 99.5% to 100% of bainitic ferrite, and less than 0.5% of unavoidable inclusion structures is produced.

In addition to using the hot-rolled steel sheet as a steel sheet for hot stamping, various kinds of steel sheets, which may be obtained by appropriately carrying out cold rolling, annealing, a plating treatment, and the like with respect to a hot-rolled steel sheet, may be used as the steel sheet for hot stamping. Each condition of the cold rolling, annealing, and plating is not particularly defined, and may be a common condition. The cold rolling may be carried out within a range of a common cold-rolling reduction ratio, for example, 40% to 80%. The plating is carried out after hot rolling, cold rolling, or recrystallization annealing, but heating conditions or cooling conditions are not particularly defined. As the plating, Zn plating or Al plating is mainly preferable. With regard to the Zn plating, an alloying treatment may be carried out or may not be carried out. With regard to the Al plating, even when Si is contained in plating, this does not have an effect on the present invention. Rough rolling of a hot-rolled steel sheet, a cold-rolled steel sheet, an annealed steel sheet, and a plated steel sheet may be appropriately carried out to appropriately adjust a shape.

In the hot stamping process, the steel sheet for hot stamping is heated to an Ac3 point or higher. When the heating temperature is lower than the Ac3 point, a region which is not austenized partially occurs. In this region, bainite or martensite is not generated, and thus sufficient strength across the entirety of a steel sheet may not be obtained.

However, the heating temperature has a great effect on the grain size of prior-austenite, and when the heating temperature exceeds 950° C., the grain size of the prior-austenite is enlarged, and thus the heating temperature is preferably 950° C. or lower.

In addition, the heating time is preferably 5 seconds to 600 seconds. When the heating time is shorter than 5 seconds, remelting of carbides is not sufficient, and it is difficult to secure solid-solution C in an amount sufficient for securing strength. On the other hand, when the heating time exceeds 600 seconds, the grain size of prior-austenite is enlarged, and thus the local deformability has a tendency to decrease.

In a case where the content of Mn+Cr is less than 1.0%, the cooling during hot stamping is carried out at a cooling rate exceeding 100° C./second. This is because when the cooling rate is 100° C./second or less, ferrite or pearlite is generated, a uniform structure is not obtained, 50% or more of λ is not obtained, and local deformability deteriorates.

On the other hand, in a case where the content of Mn+Cr is 1.0% or more, the cooling during hot stamping is carried out at a cooling rate of 10° C./second to 100° C./second. This is because when the cooling rate is less than 10° C./second, ferrite or pearlite is generated, a uniform structure is not obtained, 50% or more of λ is not obtained, and local deformability deteriorates. The cooling rate is preferably 25° C./second or more. When the cooling rate exceeds 100° C./second, tensile strength may exceed 980 MPa in some cases, and thus the upper limit of the cooling rate is set to 100° C./second. The upper limit is preferably 85° C./second or less.

In addition, it is necessary to carry out the cooling after the heating from a temperature exceeding the Ar3 point. When the cooling is initiated from a temperature of Ar3 point or lower, ferrite is generated, a uniform structure is not obtained, λ becomes low, and local deformability deteriorates.

Second Embodiment

The second embodiment of the present invention relates to an energy absorbing member including a buckling deformation portion having tensile strength of less than 980 MPa, which corresponds to the hot stamped article described in the first embodiment, and a deformation suppressing portion having tensile strength of 1180 MPa or more. That is, in the energy absorbing member, a difference in tensile strength between the buckling deformation portion and the deformation suppressing portion is designed to be 200 MPa or more.

For example, the energy absorbing member is applied to a member such as a front frame which is accompanied with particularly, axial compression deformation, and a member such as a lower portion of a center pillar which is a bending deformation portion but requires flat deformation to the some degree, among vehicle parts. The member accompanied with the axial compression deformation includes an energy absorbing portion (portion corresponding to the steel sheet for hot stamping) by buckling deformation, and a portion (portion corresponding to steel sheet for joint) such as a kick-up portion which suppresses deformation to the utmost.

The tensile strength of the buckling deformation portion (portion corresponding to the steel sheet for hot stamping) is lower than that of the deformation suppressing portion (portion corresponding to the steel sheet for joint) by 200 MPa or more so as to allow the deformation to progress in a compact mode. Even in a member in which flat deformation is necessary, tensile strength of less than 980 MPa is preferable so as to allow flat deformation to progress in the bending deformation portion.

The energy absorbing member according to this embodiment may be obtained by carrying out a hot stamping treatment by using a joined steel sheet, which is obtained by joining a steel sheet for joint to the steel sheet for hot stamping such as the hot-rolled steel sheet, the cold-rolled steel sheet, the annealed steel sheet, and the plated steel sheet which are described in the first embodiment, as a steel sheet for hot pressing.

That is, the energy absorbing member according to this embodiment is produced as follows.

(1) A slab having a component composition described in the first embodiment is heated in order for a surface temperature to be in a temperature range of Ar3 point to 1400° C., (2) The heated slab is subjected to finish rolling in which a total rolling reduction at a final stand and an immediately previous stand of the final stand is set to 40% or more in a temperature range state in which the surface temperature is Ar3 point to 1400° C., and cooling is initiated within one second after the finish rolling to produce a hot-rolled steel sheet, (3) The hot-rolled steel sheet is coiled in a temperature range of 650° C. or lower, (4) The hot-rolled steel sheet is joined to a steel sheet for joint to produce a joined steel sheet, (5) The joined steel sheet is formed by a die in a state in which the joined steel sheet is heated to a temperature of Ac3 point or higher, (6) The joined steel sheet is cooled in the die at a cooling rate exceeding 100° C./second in a case where the Mn+Cr is less than 1.0%, or the joined steel sheet is cooled in the die at a cooling rate of 10° C./second to 100° C./second in a case where the Mn+Cr is 1.0% or more to form a microstructure composed of, in terms of an area ratio, 0% or more and less than 90% of martensite, 10% to 100% of bainite, and less than 0.5% of unavoidable inclusion structures, or a microstructure composed of, in terms of an area ratio, 99.5% to 100% of bainitic ferrite, and less than 0.5% of unavoidable inclusion structures. In addition, an object, which is obtained by joining a steel sheet obtained by subjecting the hot-rolled steel sheet to any one kind or more of a cold rolling process, a continuous annealing treatment, and a plating treatment with respect to a steel sheet for joint, may be used as the joined steel sheet.

EXAMPLES

Next, examples of the present invention will be described, but a condition in the examples is only a conditional example employed to confirm reproducibility and an effect of the present invention, and the present invention is not limited to the conditional example. The present invention may employ various conditions as long as the object of the present invention may be accomplished without departing from the gist of the present invention.

Example α1

Molten steel having a component composition shown in Table 3 was taken from a converter to form a slab, and the slab was subjected to hot rolling under hot rolling conditions (a heating temperature: 1220° C., a finish temperature: 870° C., a total rolling reduction at a final stand and an immediately previous stand of the final stand: 65%, a time taken from finish rolling termination to cooling initiation: 1 second, and a coiling temperature: 630° C.) of the present invention, thereby obtaining a hot-rolled steel sheet having a sheet thickness of 3 mm.

TABLE 3

| Steel | C | Si | Mn | Cr | P | S | t-Al | Ti | Nb | V | Mo | B | N | Others | Mn + Cr | Ac3 ° C. | Ar3 ° C. |
|---|---|---|---|---|---|---|---|---|---|---|---|---|---|---|---|---|---|
| | mass % | | | | | | | | | | | | | | | | |
| A-1 | 0.0025 | 0.02 | 0.92 | 0.05 | 0.082 | 0.0021 | 0.037 | 0.021 | 0.022 | — | — | 0.0007 | 0.0015 | — | 0.97 | 945 | 751 |
| B-1 | 0.018 | 0.14 | 0.87 | 0.12 | 0.006 | 0.0028 | 0.029 | — | — | — | — | 0.0008 | 0.0021 | — | 0.99 | 879 | 765 |
| C-1 | 0.021 | 0.28 | 0.82 | 0.05 | 0.008 | 0.0034 | 0.038 | 0.048 | 0.034 | — | — | — | 0.0022 | Cu: 0.11 Ni: 0.04 Sn: 0.013 | 0.87 | 908 | 830 |
| D-1 | 0.028 | 0.12 | 0.77 | 0.21 | 0.008 | 0.0051 | 0.034 | — | 0.042 | — | 0.08 | — | 0.0015 | — | 0.98 | 877 | 802 |
| E-1 | 0.038 | 0.34 | 0.66 | 0.33 | 0.005 | 0.0032 | 0.028 | 0.014 | 0.071 | — | — | — | 0.0029 | — | 0.99 | 886 | 787 |
| F-1 | 0.048 | 0.18 | 0.85 | 0.12 | 0.007 | 0.0027 | 0.031 | 0.072 | 0.054 | — | 0.22 | 0.0006 | 0.0018 | Cu: 0.09 Ni: 0.05 Sn: 0.013 | 0.97 | 894 | 697 |
| G-1 | 0.052 | 0.15 | 0.45 | 0.45 | 0.011 | 0.0037 | 0.041 | 0.015 | 0.085 | 0.07 | — | — | 0.0023 | Cu: 0.08 Ni: 0.04 Sn: 0.012 | 0.90 | 894 | 774 |
| H-1 | 0.062 | 0.12 | 0.86 | 0.12 | 0.013 | 0.0033 | 0.028 | 0.037 | 0.052 | — | 0.47 | — | 0.0018 | — | 0.98 | 874 | 752 |
| I-1 | 0.077 | 0.46 | 0.45 | 0.52 | 0.011 | 0.0071 | 0.038 | — | — | — | — | 0.0015 | 0.0021 | — | 0.97 | 884 | 756 |
| J-1 | 0.082 | 0.21 | 0.65 | 0.33 | 0.009 | 0.0037 | 0.041 | 0.067 | — | 0.08 | 0.38 | — | 0.0023 | — | 0.98 | 891 | 797 |
| K-1 | 0.097 | 0.23 | 0.56 | 0.32 | 0.014 | 0.0024 | 0.022 | 0.045 | 0.076 | — | — | — | 0.0022 | — | 0.88 | 877 | 770 |
| L-1 | 0.0015 | 0.15 | 0.98 | 0.01 | 0.007 | 0.0093 | 0.028 | 0.015 | 0.015 | 0.05 | — | 0.0017 | 0.0024 | — | 0.99 | 907 | 758 |
| M-1 | 0.109 | 0.23 | 0.62 | 0.17 | 0.011 | 0.0035 | 0.038 | 0.024 | — | — | 0.24 | — | 0.0018 | Cu: 0.10 Ni: 0.05 Sn: 0.010 | 0.79 | 867 | 816 |
| N-1 | 0.048 | 0.72 | 0.69 | 0.28 | 0.009 | 0.0021 | 0.047 | — | — | — | — | — | 0.0018 | — | 0.97 | 902 | 852 |
| O-1 | 0.076 | 0.21 | 0.35 | 0.08 | 0.005 | 0.0077 | 0.039 | 0.027 | 0.009 | — | — | 0.0018 | 0.0015 | Cu: 0.10 Ni: 0.07 Sn: 0.013 | 0.43 | 883 | 866 |

The hot-rolled steel sheet was subjected to cold rolling to obtain a cold-rolled steel sheet of 1.4 mm, and then continuous annealing, or annealing and a plating treatment after the annealing were carried out under conditions shown in Table 4. The plating treatment was set to hot-dip zinc plating (GI (without an alloying treatment)/GA (with an alloying treatment)), or hot-dip aluminizing (Al) containing 10% of Si. In addition, after the annealing or the plating treatment, skin pass rolling was carried out with a rolling reduction shown in Table 4.

TABLE 4

| steel | Annealing temperature ° C. | Plating | Microstructure (area ratio) M | B | BF | F | Others | Skin pass % | TS before heat treatment MPa | TS after cooling MPa | λ | Plating properties | Delayed fracture | Toughness | Remark |
|---|---|---|---|---|---|---|---|---|---|---|---|---|---|---|---|
| A-1 | 800 | Al | 0 | 0 | 100 | 0 | <0.5 | 0.5 | 441 | 601 | OK | OK | OK | OK | Steel of present invention |

TABLE 4-continued

| steel | Annealing temperature ° C. | Plating | Microstructure (area ratio) M | B | BF | F | Others | Skin pass % | TS before heat treatment MPa | TS after cooling MPa | λ | Plating properties | Delayed fracture | Toughness | Remark |
|---|---|---|---|---|---|---|---|---|---|---|---|---|---|---|---|
| B-1 | 750 | Not performed | 0 | 100 | 0 | 0 | <0.5 | 0.5 | 374 | 511 | OK | — | OK | OK | Steel of present invention |
| C-1 | 770 | Al | 0 | 100 | 0 | 0 | <0.5 | 0.5 | 388 | 524 | OK | OK | OK | OK | Steel of present invention |
| D-1 | 780 | Al | 0 | 100 | 0 | 0 | <0.5 | 1.0 | 367 | 571 | OK | OK | OK | OK | Steel of present invention |
| E-1 | 750 | Not performed | 0 | 100 | 0 | 0 | <0.5 | 1.0 | 367 | 632 | OK | — | OK | OK | Steel of present invention |
| F-1 | 750 | Not performed | 70 | 30 | 0 | 0 | <0.5 | 1.0 | 385 | 711 | OK | — | OK | OK | Steel of present invention |
| G-1 | 780 | Al | 0 | 100 | 0 | 0 | <0.5 | 1.0 | 379 | 768 | OK | OK | OK | OK | Steel of present invention |
| H-1 | 780 | Not performed | 75 | 25 | 0 | 0 | <0.5 | 1.0 | 388 | 831 | OK | — | OK | OK | Steel of present invention |
| I-1 | 770 | Zn (GA) | 80 | 20 | 0 | 0 | <0.5 | 0.5 | 394 | 891 | OK | OK | OK | OK | Steel of present invention |
| J-1 | 750 | Zn (GI) | 85 | 15 | 0 | 0 | <0.5 | 1.2 | 411 | 931 | OK | OK | OK | OK | Steel of present invention |
| K-1 | 800 | Not performed | 88 | 12 | 0 | 0 | <0.5 | 1.0 | 386 | 975 | OK | — | OK | OK | Steel of present invention |
| L-1 | 780 | Al | 0 | 0 | 100 | 0 | <0.5 | 0.7 | 338 | 421 | OK | OK | OK | OK | Comparative Steel |
| M-1 | 790 | Zn (GA) | 100 | 0 | 0 | 0 | <0.5 | 1.2 | 421 | 1205 | OK | OK | OK | OK | Comparative Steel |
| N-1 | 780 | Zn (GA) | 0 | 70 | 0 | 30 | <0.5 | 1.5 | 384 | 697 | NG | NG | OK | OK | Comparative Steel |
| O-1 | 750 | Zn (GI) | 0 | 55 | 0 | 45 | <0.5 | 0.8 | 395 | 542 | NG | OK | OK | OK | Comparative Steel |

M: martensite,
B: bainite,
BF: bainitic ferrite,
F: ferrite,
Others: unavoidable inclusion structures Each of the cold-rolled and annealed steel sheet, and the aluminized steel sheet were heated to 900° C. in a heating furnace, and were interposed in a die provided with a water supply inlet through which water is ejected from the surface, and a water drain outlet which sucks in the water. Then, the steel sheet was cooled to room temperature at a cooling rate of 200° C./second, thereby simulating thermal history during hot stamping.

Each of the GI steel sheet and the GA steel sheet was heated to 870° C. by electrical heating at a heating rate of 100° C./second, was heat-retained for approximately five seconds, and then was cooled with air to Ar3 point+10° C. Similarly, each of the GI steel sheet and the GA steel sheet was interposed in a die provided with a water supply inlet through which water is ejected from the surface, and a water drain outlet which sucks in the water. Then, the steel sheet was cooled to room temperature at a cooling rate of 200° C./second, thereby simulating thermal history during hot stamping.

The tensile strength after the heat treatment was evaluated by preparing No. 5 test specimen and by performing a tensile test on the basis of JIS Z 2241 (2011). The local deformability was evaluated as λ by examining the hole expansibility by a method described in JIS Z 2256 (2010) as described above. A case in which λ was 50% or more was regarded as "pass (OK)". In addition, the delayed fracture characteristics and low-temperature toughness were also evaluated.

Figure 3:
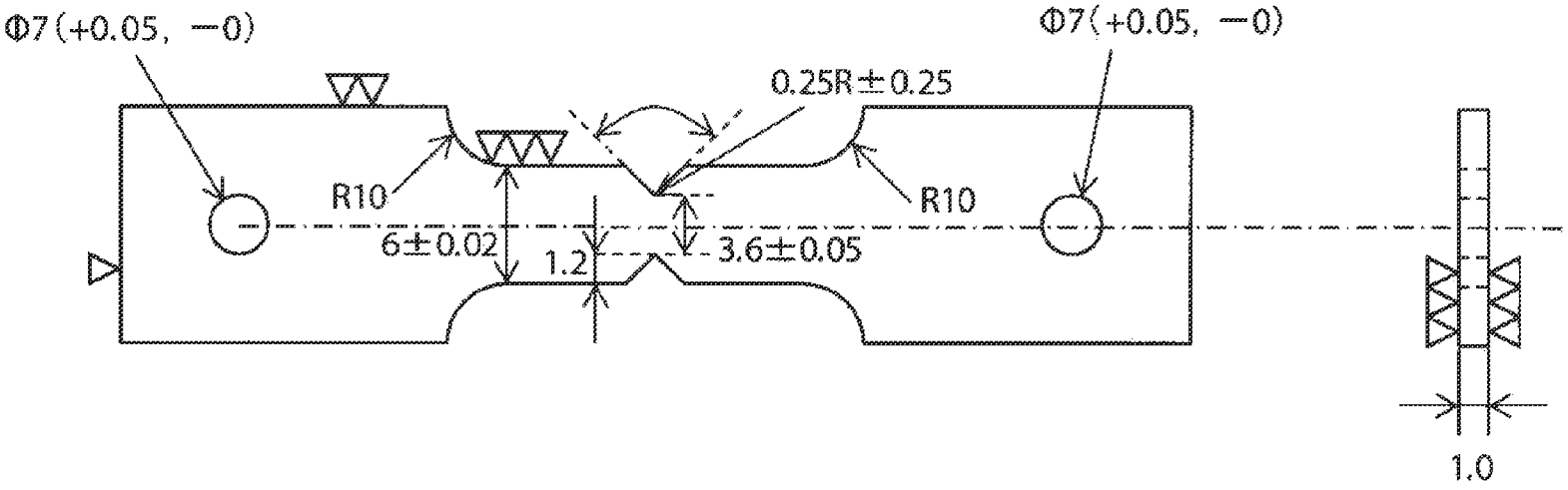
FIG. 3 is a diagram illustrating a shape of a test specimen for delayed fracture evaluation.

With regard to the delayed fracture characteristics, a V-notched test specimen shown in FIG. 3 was used, the test specimen was immersed in an aqueous solution, which was obtained by dissolving 3 g/l of ammonium thiocyanate in 3% salt solution, at room temperature for 100 hours, and evaluation was carried out by presence or absence of rupture in a state in which a load of 0.7 TS (after a heat treatment) was applied (without rupture: OK, with rupture: NG).

With regard to low-temperature brittleness, a Charpy test was carried out at −40° C., and a case in which percent ductile fracture of 50% or more was obtained was regarded as "pass (OK)", and a case in which the percent ductile fracture was less than 50% was regarded as "failure (NG)".

Results that were obtained are collectively shown in Table 4. In steel (A-1 steel to K-1 steel) according to the present invention, excellent local deformability in which TS was 490 MPa to 980 MPa was obtained, and there was no problem in the delayed fracture characteristics or the low-temperature toughness.

In L-1 steel in which the content of C was low, and deviated from the range of the present invention, the tensile strength after a heat treatment corresponding to the hot stamping was low. In M-1 steel in which the content of C was high, and deviated from the range of the present invention, the tensile strength exceeded 1180 MPa, and buckling deformation was unstable during axial compression deformation, and thus there was a concern about a decrease in energy absorbing characteristics.

In N-1 steel in which the content of Si exceeded the range of the present invention, and in O-1 steel in which the content of Mn+Cr deviated from the range of the present invention toward a lower side, ferrite was generated, and a structure became ununiform, and thus λ was lower than 50%. Therefore, there was a concern about a decrease in energy absorbing characteristics due to a decrease in the local deformability. In addition, in the N-1 steel, the content of Si deviated from the range of the present invention toward a higher side, and thus plating properties were poor.

Example α2

With regard to K-1 steel shown in Table 3, a hot-rolled steel sheet having a sheet thickness of 2 mm was obtained under hot rolling conditions within a range of the present invention (a heating temperature: 1250° C., a finish temperature: 880° C., a total rolling reduction at a final stand and an immediately previous stand of the final stand: 60%, a time taken from finish rolling termination to cooling initiation: 0.8 seconds, and a coiling temperature: 550° C.), and then the hot-rolled steel sheet was subjected to pickling.

The steel sheet after the pickling was heated to 880° C. in a heating furnace, and then was interposed in a die provided with a water supply inlet through which water is ejected from the surface, and a water drain outlet which sucks in the water. The steel sheet was cooled to room temperature at various cooling rates, thereby simulating the thermal history during hot stamping. Furthermore, the steel sheets after the pickling were subjected to zinc plating (GI, GA), or hot-dip aluminizing containing 10% of Si, and then were subjected to the same heating and cooling treatments.

With regard to the K-1 steel shown in Table 3, a hot-rolled steel sheet having a sheet thickness of 3.2 mm was obtained under hot rolling conditions within a range of the present invention (a heating temperature: 1250° C., a finish temperature: 890° C., a total rolling reduction at a final stand and an immediately previous stand of the final stand: 45%, a time taken from finish rolling termination to cooling initiation: 0.5 seconds, and a coiling temperature: 500° C.), the hot-rolled steel sheet was subjected to pickling, and a cold-rolled steel sheet of 1.6 mm was obtained at a cold rolling reduction of 50%.

The cold-rolled steel sheet was heated to 900° C. in a heating furnace, and then was interposed in a die provided with a water supply inlet through which water is ejected from the surface, and a water drain outlet which sucks in the water. The cold-rolled steel sheet was cooled to room temperature at various cooling rates, thereby simulating the thermal history during hot stamping.

Steel sheet, which was obtained by subjecting the cold-rolled steel sheet to zinc plating (GI, GA), was heated to 870° C. by electrical heating for five seconds, and was heat-retained for approximately five seconds, and then was cooled with air to 650° C. Then, the steel sheet was interposed in a die provided with a water supply inlet through which water is ejected from the surface, and a water drain outlet which sucks in the water. Then, the steel sheet was cooled to room temperature at various cooling rates, thereby simulating thermal history during hot stamping.

The same heating and cooling treatments were also carried out with respect to the steel sheet subjected to the hot-dip aluminizing containing 10% of Si. In addition, after the hot rolling, the annealing, or the plating treatment, skin pass was carried out with a rolling reduction shown in Table 4. Material characteristics of the steel sheets that were obtained were evaluated in the same manner as Example α1. Results are shown in Table 5.

TABLE 5

| Method | Kinds of steel | Cold rolling | Plating | Skin pass % | TS before heat treatment MPa | Cooling temperature ° C./sec | TS after cooling MPa | Microstructure (*) M | B | F | P | Others | λ | Delayed fracture | Toughness | Remark |
|---|---|---|---|---|---|---|---|---|---|---|---|---|---|---|---|---|
| a | K-1 | Not performed | Not performed | 1.0 | 378 | 300 | 938 | 85 | 15 | 0 | 0 | <0.5 | OK | OK | OK | Method of present invention |
| b | K-1 | Not performed | GI | 1.2 | 367 | 200 | 926 | 80 | 20 | 0 | 0 | <0.5 | OK | OK | OK | Method of present invention |
| c | K-1 | Not performed | Al | 1.5 | 369 | 150 | 915 | 75 | 25 | 0 | 0 | <0.5 | OK | OK | OK | Method of present invention |
| d | K-1 | Not performed | Not performed | 2.0 | 372 | 110 | 922 | 85 | 15 | 0 | 0 | <0.5 | OK | OK | OK | Method of present invention |
| e | K-1 | Not performed | GA | 0.8 | 372 | 50 | 425 | 0 | 0 | 30 | 70 | <0.5 | NG | OK | OK | Comparative Method |
| f | K-1 | Performed | Not performed | 1.0 | 381 | 300 | 952 | 88 | 12 | 0 | 0 | <0.5 | OK | OK | OK | Method of present invention |
| g | K-1 | Performed | GI | 1.2 | 365 | 200 | 941 | 85 | 15 | 0 | 0 | <0.5 | OK | OK | OK | Method of present invention |

TABLE 5-continued

| Method | Kinds of steel | Cold rolling | Plating | Skin pass % | TS before heat treatment MPa | Cooling temperature ° C./sec | TS after cooling MPa | Microstructure (*) M | B | F | P | Others | λ | Delayed fracture | Toughness | Remark |
|---|---|---|---|---|---|---|---|---|---|---|---|---|---|---|---|---|
| h | K-1 | Performed | Al | 1.5 | 372 | 150 | 933 | 80 | 20 | 0 | 0 | <0.5 | OK | OK | OK | Method of present invention |
| i | K-1 | Performed | Not performed | 2.0 | 380 | 110 | 931 | 85 | 15 | 0 | 0 | <0.5 | OK | OK | OK | Method of present invention |
| j | K-1 | Performed | GA | 0.8 | 381 | 50 | 410 | 0 | 0 | 35 | 65 | <0.5 | NG | OK | OK | Comparative Method |

M: martensite,
B: bainite,
F: ferrite,
P: pearlite,
Others: unavoidable inclusion structures In examples of a method a, a method b, a method c, a method d, a method f, a method g, a method h, and a method i according to methods of the invention, excellent local deformability may be obtained, and there is no problem in the delayed fracture characteristics or the low-temperature toughness.

On the other hand, in examples of a method e and a method j in which the cooling rate deviates from the range of the present invention toward a lower side, ferrite and pearlite were generated in a structure after the heat treatment, and thus strength after hot stamping was low, and θ was lower than 50%. Therefore, there was a concern about a decrease in energy absorbing characteristics due to a decrease in the local deformability.

Example α3

Figure 4:
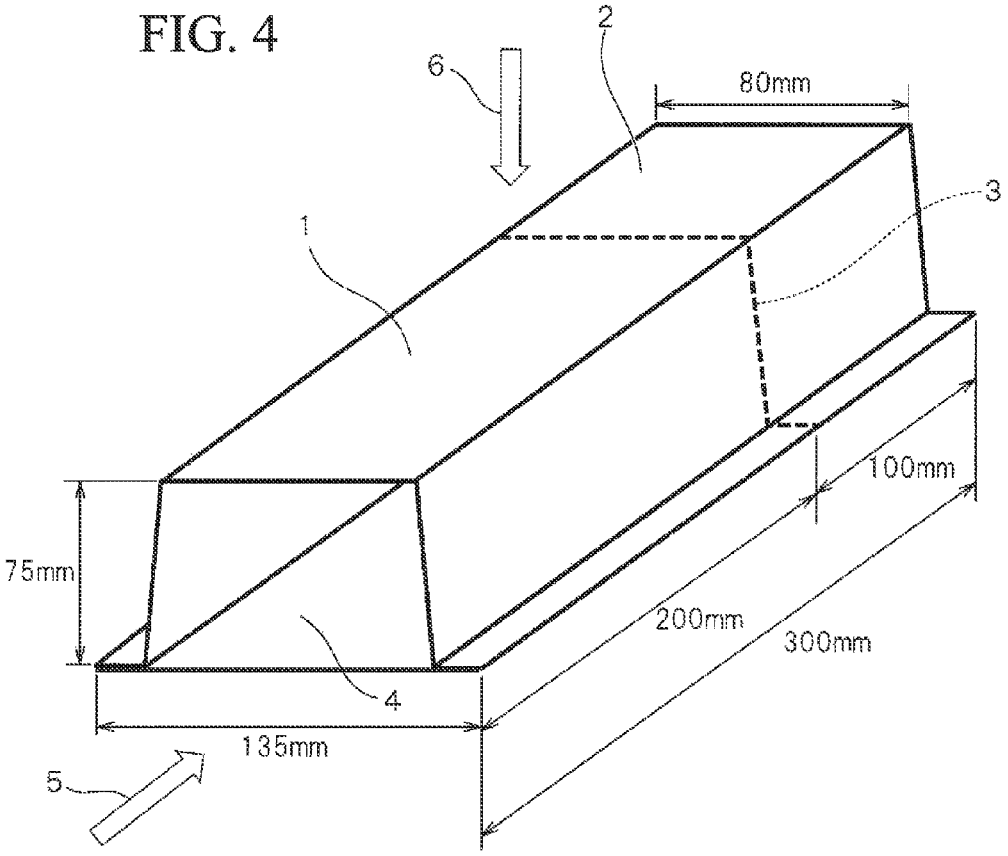
FIG. 4 is a diagram illustrating a member in which a backboard is attached to a hat type joint member obtained by hot stamping a joined steel sheet (tailored blank material), a weld line position in the joined steel sheet, and a load direction during axial compression deformation.

To prepare a member having a shape shown in FIG. 4 by hot stamping, the I-1 steel that is steel of the invention in Example α1 or O-1 steel of comparative steel was disposed at an axial compression deformation portion 1, a cold-rolled sheet of, in terms of % by mass, 0.21% C-0.2% Si-1.4% Mn-0.0025% B, which had a sheet thickness of 1.4 mm, was disposed at a portion 2 in which tensile strength after hot stamping was 1180 M Pa or more, and both steel sheets were laser-welded at a location of a laser welding portion 3.

The welded member was heated to 900° C. by an electric furnace, was heat-retained for 60 seconds, and was interposed in a die provided with a water supply inlet through which water is ejected from the surface, and a water drain outlet which sucks in the water. The laser welded member was simultaneously subjected to press forming and cooling to prepare a member having a shape shown in FIG. 4. Then, a backboard 4 having tensile strength of 590 MPa was disposed and was joined to the member by spot welding.

Small-sized tensile test specimens were prepared from the members 1 and 2, and tensile strength was measured by a tensile test. As a result, in a case of using the I-1 steel at the portion corresponding to the member 1, the tensile strength was 880 MPa, and in a case of using the O-1 steel, the tensile strength was 520 MPa. On the other hand, the tensile strength of the portion corresponding to the member 2 was 1510 MPa.

A drop weight test was carried out with respect to the member shown in FIG. 4. Deformation was applied to the member shown in FIG. 4 from a direction of a load direction 5 during axial compression deformation, which is shown in FIG. 4, with a load of 150 kg at a speed of 15 m/second. In the member using the I-1 steel that is steel of the invention, buckling deformation occurred without occurrence of cracking, but in the member using the O-1 steel of comparative steel, cracking occurred at a buckling deformation portion, and thus an amount of energy absorption decreased.

Example α4

When preparing a member having the shape shown in FIG. 4 by hot stamping, the A-1 steel and H-1 steel that are steels of the invention in Example α1 were used. Each of the members was heated to 950° C., and was heat-retained for 60 seconds. Then, similar to Example α3, the member was interposed in a die provided with a water supply inlet through which water is ejected from the surface, and a water drain outlet which sucks in the water. The member was simultaneously subjected to press forming and cooling.

A drop weight test was carried out to evaluate a deformation behavior of the member. With regard to axial compression deformation, a load of 150 kg was applied from a direction of the load direction 5 during axial compression deformation which is shown in FIG. 4 at a speed of 15 m/second. With regard to bending deformation, deformation was applied to the member from a load direction 6 during bending deformation at a speed of 5 m/second. It was confirmed that each of the members was deformed without rupture in any deformation mode, and had sufficient energy absorbing performance.

Example β1

Molten steel having a component composition shown in Table 6 was emitted from a converter to form a slab, and the slab was subjected to hot rolling under hot rolling conditions (a heating temperature: 1220° C., a finish temperature: 870° C., a total rolling reduction at a final stand and an immediately previous stand of the final stand: 65%, a time taken from finish rolling termination to cooling initiation: 1 second, and a coiling temperature: 630° C.) of the present invention, thereby obtaining a hot-rolled steel sheet having a sheet thickness of 3 mm.

TABLE 6

| Steel | C | Si | Mn | Cr | P | S | t-Al mass % | Ti | Nb | V | Mo | B | N | Others | Mn + Cr | Ac3 ° C. | Ar3 ° C. |
|---|---|---|---|---|---|---|---|---|---|---|---|---|---|---|---|---|---|
| A-2 | 0.0025 | 0.02 | 1.52 | 0.05 | 0.082 | 0.0021 | 0.037 | 0.021 | 0.022 | — | — | 0.0007 | 0.0015 | — | 1.57 | 927 | 703 |
| B-2 | 0.018 | 0.14 | 1.12 | 0.25 | 0.006 | 0.0028 | 0.029 | — | — | — | — | 0.0008 | 0.0021 | — | 1.37 | 871 | 734 |
| C-2 | 0.021 | 0.28 | 1.08 | 0.52 | 0.008 | 0.0034 | 0.038 | 0.048 | 0.002 | — | — | 0.0011 | 0.0022 | Cu: 0.09 Ni: 0.04 Sn: 0.013 | 1.60 | 901 | 717 |
| D-2 | 0.028 | 0.12 | 1.75 | 0.02 | 0.008 | 0.0051 | 0.034 | — | 0.042 | — | 0.03 | 0.0015 | 0.0015 | — | 1.77 | 848 | 663 |
| E-2 | 0.038 | 0.34 | 1.32 | 0.33 | 0.005 | 0.0032 | 0.028 | 0.014 | 0.071 | — | — | 0.0008 | 0.0029 | — | 1.65 | 866 | 654 |
| F-2 | 0.048 | 0.18 | 1.11 | 0.85 | 0.007 | 0.0027 | 0.031 | 0.072 | 0.054 | — | 0.22 | 0.0006 | 0.0018 | Cu: 0.11 Ni: 0.05 Sn: 0.013 | 1.96 | 886 | 618 |
| G-2 | 0.052 | 0.15 | 1.12 | 0.55 | 0.011 | 0.0037 | 0.041 | 0.002 | 0.085 | 0.07 | — | 0.0014 | 0.0023 | Cu: 0.08 Ni: 0.05 Sn: 0.011 | 1.67 | 869 | 632 |
| H-2 | 0.062 | 0.12 | 1.25 | 0.04 | 0.013 | 0.0033 | 0.028 | 0.037 | 0.052 | — | 0.47 | 0.0008 | 0.0018 | — | 1.29 | 862 | 647 |
| I-2 | 0.077 | 0.46 | 0.51 | 1.35 | 0.011 | 0.0071 | 0.038 | — | — | — | — | 0.0010 | 0.0021 | — | 1.86 | 882 | 685 |
| J-2 | 0.082 | 0.21 | 0.87 | 0.78 | 0.009 | 0.0037 | 0.041 | 0.067 | — | 0.08 | 0.38 | 0.0008 | 0.0023 | — | 1.65 | 885 | 663 |
| K-2 | 0.097 | 0.23 | 1.18 | 0.32 | 0.014 | 0.0024 | 0.022 | 0.045 | 0.076 | — | — | 0.0007 | 0.0022 | — | 1.50 | 858 | 641 |
| L-2 | 0.0015 | 0.15 | 1.25 | 0.25 | 0.007 | 0.0093 | 0.028 | 0.015 | 0.015 | 0.05 | — | 0.0015 | 0.0024 | — | 1.50 | 833 | 717 |
| M-2 | 0.109 | 0.23 | 1.21 | 0.33 | 0.011 | 0.0035 | 0.038 | 0.024 | — | — | 0.24 | 0.0008 | 0.0018 | Cu: 0.10 Ni: 0.04 Sn: 0.012 | 1.54 | 849 | 676 |
| N-2 | 0.048 | 0.72 | 1.32 | 0.24 | 0.009 | 0.0021 | 0.047 | — | — | — | — | 0.0011 | 0.0018 | — | 1.56 | 883 | 724 |
| O-2 | 0.039 | 0.21 | 0.72 | 0.15 | 0.005 | 0.0077 | 0.039 | 0.027 | 0.009 | — | — | 0.0018 | 0.0015 | Cu: 0.12 Ni: 0.07 Sn: 0.015 | 0.87 | 888 | 762 |
| P-2 | 0.038 | 0.22 | 1.25 | 0.26 | 0.004 | 0.0029 | 0.031 | 0.024 | — | — | 0.38 | — | 0.0023 | — | 1.51 | 868 | 769 |

The hot-rolled steel sheet was subjected to cold rolling to obtain a cold-rolled steel sheet of 1.4 mm, and then continuous annealing, or annealing and a plating treatment after the annealing were carried out under conditions shown in Table 7. The plating treatment was set to hot-dip zinc plating (GI (without an alloying treatment)/GA (with an alloying treatment)), or hot-dip aluminizing (Al) containing 10% of Si. In addition, after the annealing or the plating treatment, skin pass rolling was carried out with a rolling reduction shown in Table 7.

TABLE 7

| Steel | Annealing temperature ° C. | Plating | Microstructure (area ratio) M | B | BF | F | Others | Skin pass % | TS before heat treatment MPa | TS after cooling MPa | λ | Plating properties | Delayed fracture | Toughness | Remark |
|---|---|---|---|---|---|---|---|---|---|---|---|---|---|---|---|
| A-2 | 800 | Al | 0 | 0 | 100 | 0 | <0.5 | 0.5 | 457 | 594 | OK | OK | OK | OK | Steel of present invention |
| B-2 | 750 | Not performed | 0 | 100 | 0 | 0 | <0.5 | 0.5 | 374 | 498 | OK | — | OK | OK | Steel of present invention |
| C-2 | 770 | Al | 0 | 100 | 0 | 0 | <0.5 | 0.5 | 388 | 516 | OK | OK | OK | OK | Steel of present invention |
| D-2 | 780 | Al | 0 | 100 | 0 | 0 | <0.5 | 1.0 | 367 | 556 | OK | OK | OK | OK | Steel of present invention |
| E-2 | 750 | Not performed | 0 | 100 | 0 | 0 | <0.5 | 1.0 | 367 | 612 | OK | — | OK | OK | Steel of present invention |
| F-2 | 750 | Not performed | 50 | 50 | 0 | 0 | <0.5 | 1.0 | 385 | 694 | OK | — | OK | OK | Steel of present invention |
| G-2 | 780 | Al | 0 | 100 | 0 | 0 | <0.5 | 1.0 | 379 | 752 | OK | OK | OK | OK | Steel of present invention |
| H-2 | 780 | Not performed | 75 | 25 | 0 | 0 | <0.5 | 1.0 | 388 | 814 | OK | — | OK | OK | Steel of present invention |
| I-2 | 770 | Zn (GA) | 80 | 20 | 0 | 0 | <0.5 | 0.5 | 394 | 865 | OK | OK | OK | OK | Steel of present invention |
| J-2 | 750 | Zn (GI) | 80 | 20 | 0 | 0 | <0.5 | 1.2 | 411 | 910 | OK | OK | OK | OK | Steel of present invention |
| K-2 | 800 | Not performed | 85 | 15 | 0 | 0 | <0.5 | 1.0 | 386 | 964 | OK | — | OK | OK | Steel of present invention |
| L-2 | 780 | Al | 0 | 0 | 100 | 0 | <0.5 | 0.7 | 338 | 408 | OK | OK | OK | OK | Comparative Steel |

TABLE 7-continued

| Steel | Annealing temperature ° C. | Plating | Microstructure (area ratio) M | B | BF | F | Others | Skin pass % | TS before heat treatment MPa | TS after cooling MPa | λ | Plating properties | Delayed fracture | Toughness | Remark |
|---|---|---|---|---|---|---|---|---|---|---|---|---|---|---|---|
| M-2 | 790 | Zn (GA) | 100 | 0 | 0 | 0 | <0.5 | 1.2 | 421 | 1192 | OK | OK | OK | OK | Comparative Steel |
| N-2 | 780 | Zn (GA) | 0 | 85 | 0 | 15 | <0.5 | 1.5 | 384 | 688 | NG | NG | OK | OK | Comparative Steel |
| O-2 | 750 | Zn (GI) | 0 | 70 | 0 | 30 | <0.5 | 0.8 | 395 | 522 | NG | OK | OK | OK | Comparative Steel |
| P-2 | 790 | Not performed | 0 | 50 | 0 | 50 | <0.5 | 1.0 | 368 | 791 | NG | — | OK | OK | Comparative Steel |

M: martensite,
B: bainite,
BF: bainitic ferrite,
F: ferrite,
Others: unavoidable inclusion structures Each of the cold-rolled and annealed steel sheet, and the aluminized steel sheet was heated to 900° C. in a heating furnace, and was interposed in a die. Then, the steel sheet was cooled to room temperature at a cooling rate of 50° C./second, thereby simulating thermal history during hot stamping.

Each of the GI steel sheet and the GA steel sheet was heated to 870° C. by electrical heating at a heating rate of 100° C./second, was heat-retained for approximately five seconds, and then was cooled with air to Ar3 point+10° C. Similarly, each of the GI steel sheet and the GA steel sheet was interposed in a die. Then, the steel sheet was cooled to room temperature at a cooling rate of 50° C./second, thereby simulating thermal history during hot stamping.

The tensile strength after the heat treatment was evaluated by preparing No. 5 test specimen and by performing a tensile test on the basis of JIS Z 2241 (2011). The local deformability was evaluated as λ, by examining the hole expansibility by a method described in JIS Z 2256 (2010) as described above. A case in which λ was 50% or more was regarded as "pass (OK)". In addition, the delayed fracture characteristics and low-temperature toughness were also evaluated.

With regard to the delayed fracture characteristics, a V-notched test specimen shown in FIG. 3 was used, the test specimen was immersed in an aqueous solution, which was obtained by dissolving 3 g/l of ammonium thiocyanate in 3% salt solution, at room temperature for 100 hours, and determination was carried out by presence or absence of rupture in a state in which a load of 0.7 TS (after a heat treatment) was applied (without rupture: OK, with rupture: NG).

With regard to low-temperature brittleness, a Charpy test was carried out at −40° C., and a case in which percent ductile fracture of 50% or more was obtained was regarded as "pass (OK)", and a case in which the percent ductile fracture was less than 50% was regarded as "failure (NG)".

Results that were obtained are collectively shown in Table 7. In steels (A-2 steel to K-2 steel) according to the present invention, excellent local deformability in which TS was 490 MPa to 980 MPa was obtained, and there was no problem in the delayed fracture characteristics or the low-temperature toughness.

In L-2 steel in which the content of C was low, and deviated from the range of the present invention, the tensile strength after a heat treatment corresponding to the hot stamping was low. In M-2 steel in which the content of C was high, and deviated from the range of the present invention, the tensile strength exceeded 1180 MPa, and buckling deformation was unstable during axial compression deformation, and thus there was a concern about a decrease in energy absorbing characteristics.

In N-2 steel in which the content of Si exceeded the range of the present invention, in O-2 steel in which the content of Mn+Cr was low due to a cooling rate of 50° C./second, and in P-2 steel in which the content of Mn+Cr was 1.0% or more, and B was not added, ferrite was generated, and a structure became nonuniform, and thus was lower than 50%. Therefore, there was a concern about a decrease in energy absorbing characteristics due to a decrease in the local deformability. In addition, in the M-2 steel, the content of Si deviated from the range of the present invention toward a higher side, and thus plating properties were poor.

Example β2

With regard to K-2 steel shown in Table 6, a hot-rolled steel sheet having a sheet thickness of 2 mm was obtained under hot rolling conditions within a range of the present invention (a heating temperature: 1250° C., a finish temperature: 880° C., a total rolling reduction at a final stand and an immediately previous stand of the final stand: 60%, a time taken from finish rolling termination to cooling initiation: 0.8 seconds, and a coiling temperature: 550° C.), and then the hot-rolled steel sheet was subjected to pickling.

The steel sheet after the pickling was heated to 880° C. in a heating furnace, and then was interposed in a die. The steel was cooled to room temperature at various cooling rates, thereby simulating the thermal history during hot stamping. Furthermore, the steel sheets after the pickling were subjected to zinc plating (GI, GA), or hot-dip aluminizing containing 10% of Si, and then were subjected to the same heating and cooling treatments.

With regard to the K-2 steel shown in Table 7, a hot-rolled steel sheet having a sheet thickness of 3.2 mm was obtained under hot rolling conditions within a range of the present invention (a heating temperature: 1250° C., a finish temperature: 890° C., a total rolling reduction at a final stand and an immediately previous stand of the final stand: 45%, a time taken from finish rolling termination to cooling initiation: 0.5 seconds, and a coiling temperature: 500° C.), the hot-rolled steel sheet was subjected to pickling, and a cold-rolled steel sheet of 1.6 mm was obtained at a cold rolling reduction of 50%.

The cold-rolled steel sheet was heated to 900° C. in a heating furnace, and then was interposed in a die. The cold-rolled steel sheet was cooled to room temperature at various cooling rates, thereby simulating the thermal history during hot stamping. Furthermore, steel, which was obtained by subjecting the cold-rolled steel sheet to zinc plating (GI, GA), was heated to 870° C. by electrical heating for five seconds, and was heat-retained for approximately five seconds, and then was cooled with air to 650° C. Then, the steel was interposed in a die. Then, the steel was cooled to room temperature at various cooling rates, thereby simulating thermal history during hot stamping.

The steel, which was subjected to the hot-dip aluminizing containing 10% of Si, was heated to 880° C. in a heating furnace, and was interposed in a die, and was cooled to room temperature at various cooling rates, thereby simulating thermal history during hot stamping. In addition, after the hot rolling, the annealing, or the plating treatment, skin pass was carried out with a rolling reduction shown in Table 8.

Material characteristics of the steel sheets that were obtained were evaluated in the same manner as Example β1. Results that were obtained are shown in Table 8.

TABLE 8

| Method | Kinds of steel | Cold rolling | Plating | Skin pass % | TS before heat treatment MPa | Cooling temperature ° C./sec | TS after cooling MPa | Microstructure (*) M | B | F | P | Others | λ | Delayed fracture | Toughness | Remark |
|---|---|---|---|---|---|---|---|---|---|---|---|---|---|---|---|---|
| a' | K-2 | Not performed | Not performed | 1.0 | 378 | 100 | 958 | 85 | 15 | 0 | 0 | <0.5 | OK | OK | OK | Method of present invention |
| b' | K-2 | Not performed | GI | 1.2 | 367 | 50 | 924 | 80 | 20 | 0 | 0 | <0.5 | OK | OK | OK | Method of present invention |
| c' | K-2 | Not performed | Al | 1.5 | 369 | 25 | 931 | 75 | 25 | 0 | 0 | <0.5 | OK | OK | OK | Method of present invention |
| d' | K-2 | Not performed | Not performed | 2.0 | 372 | 10 | 927 | 70 | 30 | 0 | 0 | <0.5 | OK | OK | OK | Method of present invention |
| e' | K-2 | Not performed | GA | 0.8 | 372 | 5 | 457 | 0 | 0 | 50 | 50 | <0.5 | NG | OK | OK | Comparative Method |
| f' | K-2 | Performed | Not performed | 1.0 | 381 | 100 | 955 | 88 | 12 | 0 | 0 | <0.5 | OK | OK | OK | Method of present invention |
| g' | K-2 | Performed | GI | 1.2 | 365 | 50 | 941 | 85 | 15 | 0 | 0 | <0.5 | OK | OK | OK | Method of present invention |
| h' | K-2 | Performed | Al | 1.5 | 372 | 25 | 936 | 80 | 20 | 0 | 0 | <0.5 | OK | OK | OK | Method of present invention |
| i' | K-2 | Performed | Not performed | 2.0 | 380 | 10 | 911 | 70 | 30 | 0 | 0 | <0.5 | OK | OK | OK | Method of present invention |
| j' | K-2 | Performed | GA | 0.8 | 381 | 5 | 451 | 0 | 0 | 45 | 55 | <0.5 | NG | OK | OK | Comparative Method |

M: martensite,
B: bainite,
F: ferrite,
P: pearlite,
Others: unavoidable inclusion structures In examples of a method a', a method b', a method c', a method d', a method f', a method g', a method h', and a method i' according to methods of the invention, excellent local deformability may be obtained, and there is no problem in the delayed fracture characteristics or the low-temperature toughness.

On the other hand, in examples of a method e' and a method j' in which the cooling rate deviates from the range of the present invention, ferrite and pearlite were generated in a structure after the heat treatment, and thus strength after hot stamping was low, and λ was lower than 50%. Therefore, there was a concern about a decrease in energy absorbing characteristics due to a decrease in the local deformability.

Example β3

To prepare a member having a shape shown in FIG. 4 by hot stamping, a steel sheet of the I-2 steel that is steel of the invention in Example 131 or 0-2 steel of comparative steel was disposed at the axial compression deformation portion 1, a cold-rolled steel sheet of in terms of % by mass, 0.21% C-0.2% Si-2.4% Mn-0.0025% B, which had a sheet thickness of 1.4 mm, was disposed at the portion 2 in which tensile strength after hot stamping was 1180 MPa or more, and both steel sheets were laser-welded at a location of the laser welding portion 3.

The welded member was heated to 900° C. by an electric furnace, was heat-retained for 60 seconds, and was interposed in a die. The welded member was simultaneously subjected to press forming and cooling to prepare a member having a shape shown in FIG. 4. Then, a backboard 4 having tensile strength of 590 MPa was disposed and was joined to the member by spot welding.

Small-sized tensile test specimens were prepared from the members 1 and 2, and tensile strength was measured by a tensile test. As a result, in a case of using the I-2 steel at the portion corresponding to the member 1, the tensile strength was 880 MPa, and in a case of using the 0-2 steel, the tensile strength was 520 MPa. On the other hand, the tensile strength of the portion 2 corresponding to the member 2 was 1510 MPa. Accordingly, a difference (ΔTS) in tensile strength after hot stamping was 200 MPa or more.

A drop weight test was carried out with respect to the member shown in FIG. 4. Deformation was applied to the member shown in FIG. 4 from a direction of the load direction 5 during axial compression deformation, which is shown in FIG. 4, with a load of 150 kg at a speed of 15 m/second. In the member using the I-2 steel that is steel of the invention, buckling deformation occurred without occurrence of cracking. However, in the member using the 0-2 steel of comparative steel, ferrite and bainite were generated, and a microstructure became ununiform. According to this, cracking occurred at the buckling deformation portion, and an amount of energy absorption decreased.

Example β4

When preparing a member having the shape shown in FIG. 4 by hot stamping, the A-2 steel and H-2 steel that are steel of the invention in Example β1 were used. Each steel sheet of the members was heated to 950° C., and was heat-retained for 60 seconds. Then, similar to Example β3, the steel sheet was interposed in a die. The steel sheet was simultaneously subjected to press forming and cooling.

A drop weight test was carried out to evaluate a deformation behavior of the member. With regard to axial compression deformation, a load of 150 kg was applied from a direction of the load direction 5 during axial compression deformation which is shown in FIG. 4 at a speed of 15 m/second. With regard to bending deformation, deformation was applied to the member from a load direction 6 during bending deformation at a speed of 5 m/second. It was confirmed that each of the members was deformed without rupture in any deformation mode, and had sufficient energy absorbing performance.

INDUSTRIAL APPLICABILITY

As described above, according to the present invention, in a case of producing parts utilizing a tailored blank material, with respect to an axial compression deformation portion, tensile strength after hot stamping may be suppressed to be low, and thus local deformability may be applied to the parts. As a result, a member which is excellent in energy absorbing characteristics during axial compression deformation and bending deformation may be produced. Accordingly, the present invention has high applicability in mechanical part production industry.

DESCRIPTION OF REFERENCE NUMERALS AND SIGNS

1: Axial compression deformation portion
2: Portion in which tensile strength after hot stamping ≥1180 Mpa
3: Laser welded portion
4: Backboard
5: Load direction during axial compression deformation
6: Load direction during bending deformation

The invention claimed is:

1. A hot stamped article that is obtained by hot stamping a steel sheet for hot stamping, the hot stamped article having a component composition comprising, in terms of % by mass:
0.002% to 0.1% of C;
0.01% to 0.5% of Si;
0.5% or more and less than 1.0% of Mn+Cr;
0.1% or less of P;
0.01% or less of S;
0.05% or less oft-Al;
0.005% or less of N; and
remainder being Fe and unavoidable impurities,
wherein the hot stamped article has a microstructure consisting of, in terms of an area ratio, 70% or more and less than 90% of martensite, 10% to 30% of bainite, and less than 0.5% of unavoidable inclusion structures, or a microstructure consisting of, in terms of an area ratio, 99.5% to 100% of bainitic ferrite, and less than 0.5% of unavoidable inclusion structures, by performing cooling at a cooling rate exceeding 100° C./second during hot stamping,
wherein λ obtained by a method described in JIS Z 2256 (2010) is 50% or more, and
wherein a tensile strength of the hot stamped article is less than 980 MPa.

2. The hot stamped article according to claim 1,
wherein a plated layer is provided on a surface of the hot stamped article.

3. The hot stamped article according to claim 1, wherein the component composition further comprises one or more kinds selected from, in terms of % by mass,
0.001% to 0.1% of Ti,
0.001% to 0.05% of Nb,
0.005% to 0.1% of V, and
0.02% to 0.5% of Mo.

4. The hot stamped article according to claim 1, wherein the component composition further comprises, in terms of % by mass, 0.0005% to 0.004% of B.

5. An energy absorbing member, comprising:
the hot stamped article according to any one of claims 1 to 4; and
a joint member which is joined to the hot stamped article and has tensile strength of 1180 MPa or more,
wherein a difference in tensile strength between the hot stamped article and the joint member is 200 MPa or more.

6. A method of producing a hot stamped article, the method comprising:
a heating process of heating a slab in order for a surface temperature to be in a temperature range of Ar3 point to 1400° C., the slab having a component composition comprising, in terms of % by mass, 0.002% to 0.1% of C, 0.01% to 0.5% of Si, 0.5% or more and less than 1.0% of Mn+Cr, 0.1% or less of P, 0.01% or less of S, 0.05% or less of t-Al, 0.005% or less of N, remainder being Fe and unavoidable impurities;
a hot rolling process of subjecting the heated slab to finish rolling in which a total rolling reduction at a final stand and an immediately previous stand of the final stand is set to 40% or more in a temperature range state in which the surface temperature is Ar3 point to 1400° C., and initiating cooling within one second after the finish rolling to produce a hot-rolled steel sheet;

a coiling process of coiling the hot-rolled steel sheet in a temperature range of 650° C. or lower; and a hot stamping process of using the hot-rolled steel sheet as a steel sheet for hot stamping, forming the steel sheet for hot stamping using a die in a state in which the steel sheet is heated to a temperature of Ac3 point or higher, cooling the steel sheet for hot stamping in the die at a cooling rate exceeding 100° C./second to produce a hot stamped article having a microstructure consisting of, in terms of an area ratio, 70% or more and less than 90% of martensite, 10% to 30% of bainite, and less than 0.5% of unavoidable inclusion structures, or a microstructure consisting of, in terms of an area ratio, 99.5% to 100% of bainitic ferrite, and less than 0.5% of unavoidable inclusion structures, wherein the hot stamped article has a tensile strength of less than 980 MPa.

7. The method of producing a hot stamped article according to claim 6, the method further comprising:

a plating process of carrying out a plating treatment with respect to the hot-rolled steel sheet before the hot stamping process, wherein in the hot stamping process, the hot-rolled steel sheet to which the plating treatment is carried out is used as the steel sheet for hot stamping.

8. The method of producing a hot stamped article according to claim 6, the method further comprising:

a cold rolling process of producing a cold-rolled steel sheet by carrying out cold rolling with respect to the hot-rolled steel sheet before the hot stamping process, wherein in the hot stamping process, the cold-rolled steel sheet is used as the steel sheet for hot stamping.

9. The method of producing a hot stamped article according to claim 6, the method further comprising:

a cold rolling process of producing a cold-rolled steel sheet by carrying out cold rolling with respect to the hot-rolled steel sheet before the hot stamping process; and a plating treatment process of carrying out a plating treatment with respect to the cold-rolled steel sheet, wherein in the hot stamping process, the cold-rolled steel sheet to which the plating treatment is carried out is used as the steel sheet for hot stamping.

10. The method of producing a hot stamped article according to claim 6, the method further comprising:

a cold rolling process of producing a cold-rolled steel sheet by carrying out cold rolling with respect to the hot-rolled steel sheet before the hot stamping process; and a continuous annealing process of carrying out continuous annealing with respect to the cold-rolled steel sheet, wherein in the hot stamping process, the cold-rolled steel sheet to which the continuous annealing is carried out is used as the steel sheet for hot stamping.

11. The method of producing a hot stamped article according to claim 6, the method further comprising:

a cold rolling process of producing a cold-rolled steel sheet by carrying out cold rolling with respect to the hot-rolled steel sheet before the hot stamping process;

a continuous annealing process of carrying out continuous annealing with respect to the cold-rolled steel sheet; and a plating treatment process of carrying out a plating treatment with respect to the cold-rolled steel sheet to which the continuous annealing is carried out, wherein in the hot stamping process, the cold-rolled steel sheet to which the continuous annealing and the plating treatment are carried out is used as the steel sheet for hot stamping.

12. The method of producing a hot stamped article according to claim 6, wherein the slab further comprises one or more kinds selected from, in terms of % by mass, 0.001% to 0.1% of Ti, 0.001% to 0.05% of Nb, 0.005% to 0.1% of V, and 0.02% to 0.5% of Mo.

13. The method of producing a hot stamped article according to claim 6, wherein the slab further comprises, in terms of % by mass, 0.0005% to 0.004% of B.

14. A method of producing an energy absorbing member, the method comprising:

a joining process of joining the steel sheet for hot stamping according to any one of claims 6 to 13 to a steel sheet for joint to produce a joined steel sheet; and a hot stamping process of forming the joined steel sheet using a die in a state in which the joined steel sheet is heated to a temperature of Ac3 point or higher, and cooling the joined steel sheet in the die at a cooling rate exceeding 100° C./second so as to set a difference in tensile strength between a portion corresponding to the steel sheet for hot stamping and a portion corresponding to the steel sheet for joint in the joined steel sheet to 200 MPa or more.

* * * * *